US009403178B2

(12) United States Patent
Mologousis

(10) Patent No.: US 9,403,178 B2
(45) Date of Patent: Aug. 2, 2016

(54) VEHICLE BASED SPRAY SYSTEM

(71) Applicant: William Mologousis, Burr Ridge, IL (US)

(72) Inventor: William Mologousis, Burr Ridge, IL (US)

(73) Assignee: PWS I.P., LLC, Cicero, IL (US)

( * ) Notice: Subject to any disclaimer, the term of this patent is extended or adjusted under 35 U.S.C. 154(b) by 679 days.

(21) Appl. No.: 13/751,860

(22) Filed: Jan. 28, 2013

(65) Prior Publication Data

US 2013/0193231 A1 Aug. 1, 2013

Related U.S. Application Data

(60) Provisional application No. 61/590,956, filed on Jan. 26, 2012.

(51) Int. Cl.

| | |
|---|---|
| ***B08B 3/02*** | (2006.01) |
| ***B05B 15/06*** | (2006.01) |
| ***B08B 3/08*** | (2006.01) |
| ***B08B 3/10*** | (2006.01) |
| ***B08B 3/14*** | (2006.01) |

(52) U.S. Cl.
CPC ..... *B05B 15/06* (2013.01); *B08B 3/024* (2013.01); *B08B 3/08* (2013.01); *B08B 3/10* (2013.01); *B08B 3/14* (2013.01)

(58) Field of Classification Search
CPC ..... B08B 3/024; B08B 3/14
See application file for complete search history.

(56) References Cited

U.S. PATENT DOCUMENTS

| | | | | |
|---|---|---|---|---|
| 4,845,801 | A | 7/1989 | Milly et al. | |
| 5,287,589 | A | 2/1994 | Hughes | |
| 5,469,597 | A | 11/1995 | Page | |
| 5,469,598 | A | 11/1995 | Sales | |
| 5,979,012 | A | 11/1999 | Fritz | |
| 6,381,801 | B1 | 5/2002 | Clemons, Sr. | |
| 6,675,437 | B1 | 1/2004 | York | |
| 2007/0068879 | A1 * | 3/2007 | Markle | B63J 4/006 210/760 |

OTHER PUBLICATIONS

Whitco Cleaning Systems, "The Whitco GPO Series Information Sheet," published on the internet at—http://www.whitcocleaningsystems.com//Utilities//getMedia.aspx?x=FWZxiXP7y12sKbihgLMo2xdLduexraq%2bMbZdtl5eaY2JX%2bs5jXobsx1VIWitElhwUuKa9jj0kFfus%2b%2bwzQFssL25JFSsc4BW; believed published no later than circa Dec. 31, 2011 by Whitco Cleaning Systems.

Whitco Cleaning Systems, "The Whitco Cleanliner Series Information Sheet," published on the internet at—http://www.whitcocleaningsystems.com//Utilities//getMedia.aspx?x=FWZxiXP7y13PsAjzG%2bAqwvxQ2Rxclz%2bjSDIchwTxXL0h6adTkdApWxa05oow1QBR0n7N2YjOS4MLtZLh%2b9KV2xhyE5mqFu9R; believed published no later than circa Dec. 31, 2011 by Whitco Cleaning Systems.

(Continued)

*Primary Examiner* — Jason Ko
(74) *Attorney, Agent, or Firm* — Justin Lampel

(57) ABSTRACT

A mobile system for dispensing cleaning fluid at a jobsite comprising a vehicle with wheels and an interior; a lower level provided in the interior; an upper level provided in the interior and separated from the underlying lower level by a deck; a clean fluid supply tank located on the lower level; at least one outflow pump downstream from and in communication with the clean fluid supply tank arranged on the upper level; and, at least one spray hose for dispensing fluid from the clean fluid supply, the spray hose downstream from and in communication with the at least one pump, at least a portion of the at least one spray hose external to the vehicle for dispensing the fluid at the jobsite.

20 Claims, 18 Drawing Sheets

(56) References Cited

OTHER PUBLICATIONS

Power Line USA, "Trailer Power Washers Information and Specifications Sheet," published on the internet at—http://www.powerlineindustries.com/trailer.htm; believed published no later than circa Dec. 31, 2011 by Power Line Industries USA.

Power Line USA, "Hot/Cold/Steam Skid Power Washers Information and Specifications Sheet," published on the internet at—http://www.powerlineindustries.com/skid_units.htm; believed published no later than circa Dec. 31, 2011 by Power Line Industries USA.

* cited by examiner

VEHICLE BASED SPRAY SYSTEM

CROSS REFERENCE

The present application claims priority on copending U.S. Provisional Application No. 61/590,956, filed on Jan. 26, 2012; which application is incorporated herein by reference.

FIELD

A field of the invention is vehicle based spray and filter systems. Another field is mobile closed loop spraying systems.

BACKGROUND

Many applications exist for portable washing, spraying or cleaning systems. Some examples include removal of oil, greases, dirt, soot, heavy metals, fuels, emulsions, paints, and other contaminants from locations, buildings, machines, or the like. As a specific example, when flooding occurs buildings, parking lots, streets or even entire towns may have soot, mid silt, category 3 waste water and other debris deposited thereon that requires removal and washing. In such applications, truck based spraying systems may be used that apply a spray wash to the debris. The resultant spray water after application may be contaminated and carry poisons, waste, or other hazardous or environmentally unfriendly material. To avoid taxing a sewer or other drainage system with this material, in many applications it may be necessary to remove any water or other fluid used to spray wash following its application.

As a result, so-called closed-loop mobile spray systems have been proposed that will recycle their water. To date, however, such systems have left many needs unsatisfied. Some of these needs relate to scale of the systems. For many applications, significant cleaning is required. Currently available systems cannot satisfy such applications. Also, in many applications including floods and other natural disasters, vehicle congestion can become an issue at clean-up sites. In such circumstances problems are presented when a large number of vehicles are required for clean-up.

SUMMARY

One example embodiment of the invention is a mobile system for dispensing and recovering water comprising a vehicle with wheels; a clean water supply located on a first vertical level in the vehicle; a recycle water supply tank located on the first vertical level; one or more first pumps downstream from and in communication with the clean water supply located on a second vertical level; one or more spray hoses for dispensing the water downstream from and in communication with the one or more pumps; a water intake collector for collecting dispensed water; one or more second pumps in communication with and downstream from the water intake collector located on the second level; one or more filters in communication with and downstream from the water intake collector and located on the second level; and, a holding tank downstream from and in communication with the filters.

DETAILED DESCRIPTION

Figure 1:
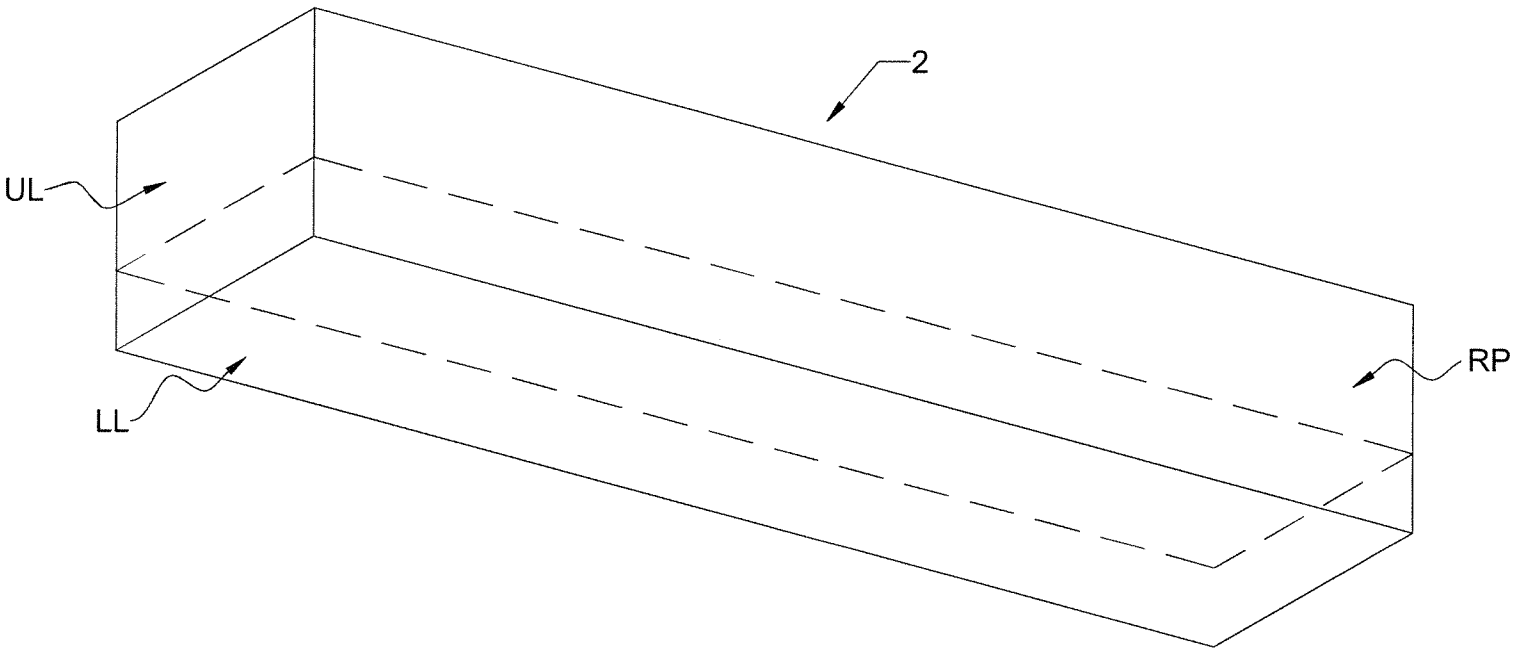
FIG. 1 includes a perspective view of an example trailer as well as a schematic illustration of the same.

Before discussing example embodiments, it will be useful to consider an element list for elements shown in the attached Figs. Element list for Attached Figures:

| | |
|---|---|
| Trailer | 2 |
| Trailer Upper Level | UL |
| Trailer Lower Level | LL |
| Trailer Rear Portion | RP |
| Rear tank (filtered returned fluid) | 4 |
| Front tank (clean fluid) | 6 |
| Pressure Washers | 8 |
| Pressure Washer manifold | 10 |
| Filtration system | 12 |
| Detergent/Chemical Tanks | 14 |
| First filter tank | 20 |
| Second filter tank | 21 |
| Filter line | 22 |
| Cyclone separator | 24 |
| Float switch activated pump | 25 |
| Bag filters | 26 |
| H-P storage tank | 28 |
| Flow meter | 30 |
| Filter line | 32 |
| Inlet from recovery pumps | 34 |
| Control box for pump w/ float to recovery | 36 |
| Cyclone Separator Purge Controller | 38 |
| Automatic Purge Controller | 40 |
| Degreaser line | 42 |
| Soap Line | 44 |
| Water line (rear tank) | 46 |
| water line (front tank) | 48 |

-continued

| | |
|---|---|
| outlet from Manifold Cabinet | 50 |
| outlet from Manifold Cabinet | 52 |
| Pressure outlets | 54 |
| Storage | 56 |
| Pumps (part of manifold cabinet) | 58 |
| Pump switch and heat switch | 60 |
| Pump switch and heat switch | 62 |
| Pump switch and heat switch | 64 |
| Pump switch and heat switch | 66 |
| Main Breaker | 68 |
| Filtration System Switch | 70 |
| Waterproof power receptacles | 72 |
| Duplex double gang receptacle | 74 |
| Junction box | 76 |

This list of elements is not exclusive of the numerous features shown in the attached Figs. Indeed, numerous additional features and elements are illustrated and/or discussed below, but for sake of brevity need not be referenced or otherwise called out by specific element number.

Many important aspects of some present invention embodiments are related to its scale. Through the novel aspects of present invention embodiments, more washing power is provided in a single vehicle than has been previously possible. This is achieved, at least in part, through a unique multi-level vertical arrangement of fluid containers, pumps, heaters, filters and related components. Through arranging these components on two vertical levels within a vehicle such as a tractor trailer shown generally at 2 in FIGS. 1-3, space saving and other efficiency advantages are gained.

Many invention embodiments are provided in the form of trucks. A variety of different trucks are suitable, but many invention embodiments find particular utility through use of tractor trailer or semi-trailer trucks (or "semis") that include a detachable vehicle trailer 2 including a wheel set near the rear of the trailer, and attachment configuration for attachment to a pulling tractor truck near the trailer front. Trailers can be outfitted in the manner described herein, and then be used interchangeably with different tractors or pulling trucks. Also, trailers can be left at job sites while the tractor or pulling truck is driven away for use on another job. Other advantages include that multiple trailers can be pulled by a single tractor or pulling truck when necessary.

Maximum trailer 2 size and weight is often subject to federal regulation, and invention embodiments adhere to these limits. Trailers of the invention, may be, for example, a standard 28 foot length, 102 inch width, and 13.5 foot height. Tractors and trailers are available from many known vendors, with examples including Navistar, Freightliner, Peterbuilt, Volvo and others. The trailer may include single or double axles, rear and side service doors, and other features.

Highly Compact Design with Multiple Vertical Levels

Some advantages of example invention embodiments include providing multiple components in a single vehicle trailer 2, as is illustrated in FIGS. 1-3, 10B and others. It has been discovered that use of multiple vertical levels, including for example an upper level shown generally at UL and a lower level shown generally at LL, within a vehicle trailer 2 can be useful to achieve a highly effective trailer in a compact, convenient and efficient manner that features high capacity in a small footprint as well as good handling and drivability characteristics.

In some invention embodiments, clean and spent fluid tanks (elements 4 and 6, respectively, of FIGS. 2, 10B and others) as well as other relatively heavy or bulky components are provided on a lower level LL, while components such as a pumps, filter systems, and the like are provided on an upper level UL that sits above the lower level LL within the trailer. This achieves good weight load and center of gravity characteristics. For convenience, plumbing and electrical connections can also be arranged on the lower level LL.

Different heights of the two or more levels LL and UL will be useful as may be desired for particular applications. In many applications, total vehicle height is limited by federal regulations, with the result that many trailers feature a generally uniform interior and exterior height. In such applications, it has been discovered that advantages are achieved by having at least one level (often the upper level UL) with sufficient height for an operator to walk about therein. Levels may be divided by removable decking supported by a frame attached to the vehicle walls, floor or ceiling. In some embodiments a framework of horizontal metal cross members is formed and supported from the vehicle floor, with lighter weight decking supported thereon. Deck access panels may be provided as desired to allow access to a lower level. Also, more than two levels can be provided, and differing heights of a single level can be provided as desired.

In embodiments including two levels, various heights of the two levels UL and LL have been discovered to offer good balances between various competing design considerations. As an example, it is desirable to maximize fluid storage, which suggests maximizing the height of the lower level in which fluid is stored. Too high of a lower level LL height, however, can negatively impact center of gravity issues (if fluid is carried in the entire lower level). It has been discovered that a favorable balance between competing factors is achieved when the lower level LL has a height that is less than half the total height of the vehicle and the upper level UL more than half the total height. A more favorable ratio is achieved when the lower level LL height is no more than 33% of the total interior height and the upper level UL height no more than 67% of the interior total height. In still other embodiments, the lower level LL height is no more than 25% of the total interior height.

Through providing a relatively large number of components arranged vertically on multiple levels in a vehicle trailer, space efficiency is achieved that leads to multiple advantages and benefits. These include, but are not limited to:

- A single vehicle of the invention replaces multiple individual vehicles of the prior art—in some cases 10 or more. This leads to important fuel savings, traffic and parking congestion benefits, and significant cost savings.
- In natural disaster applications, by way of example, vehicle congestion can be a significant issue. In such applications, 3 28 foot vehicle trailers of the present invention can replace what previously required between 9 and 18 28 ft units.
- Multiple continuous service heavy duty industrial pressure washers capable of high pressure and temperature in a single trailer.
- Storage containers for over 3000 plus gallons of fresh or recycled water for use in the continuous cleaning operations
- Through provision of a self contained, closed loop system that is able to filter and recycle generated waste water, adding or introducing more water to areas that have already reached their saturation point is avoided.
- Another inherent benefit to filtering and recycling is a reduced need for replenishment of water supply. This reduces slowdowns and allows the cleaning operation of and decontamination processes to be completed faster in an environment where time is always of great importance. Put another way, the longer vehicles can continue to clean before needing to reload an acceptable water supply (which often requires leaving the jobsite) the sooner the project can be finished.

Fluid Retrieval and Filtration Systems

Importantly, all (or substantially all) fluid dispensed from some invention embodiments is retrieved from outside of the vehicle, returned to the vehicle via pumps where it is cleaned for disposal or re-use. In some applications it is stored for later disposal at a different site. In other applications it is constantly reused by the vehicle—after return from outside of the vehicle it is cleaned and returned to a holding tank 4 for re-use. In this manner, some invention embodiments are closed loop systems.

Figure 18:
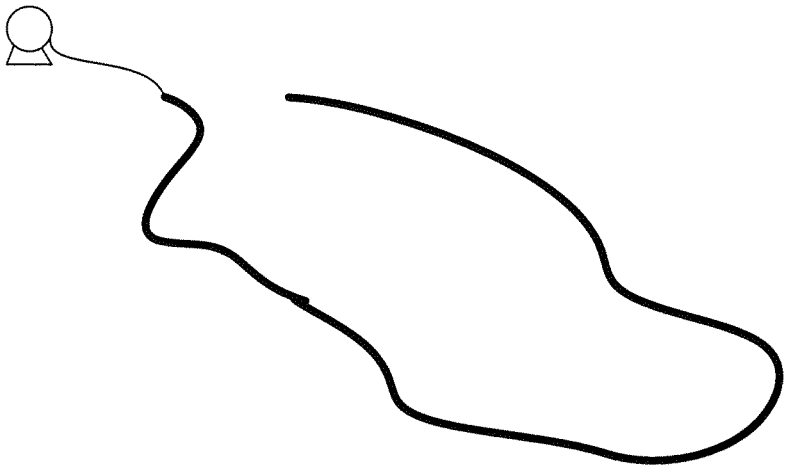
FIG. 18 schematically illustrates an example boom collector.

Spent wash water can be retrieved using one or more of vacuum booms, catch basins, large debris filtering cages, and water and poly booms. FIG. 18 schematically illustrates an example boom collector. Vacuum/water/poly booms include a hose or other conduit member (the boom) that is spread on the ground to define a perimeter. The boom captures dispensed fluid within its perimeter, and has multiple perforations or passages about its lower side. When vacuum is pulled on the boom, fluid contained within the boom perimeter is drawn into the boom.

Figure 19:
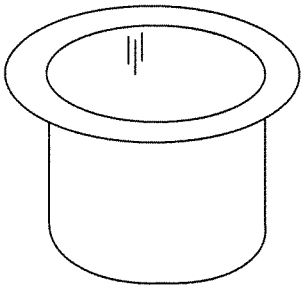
FIG. 19 schematically illustrates an example catch basin.

FIG. 19 schematically shows an example catch basin. Catch basins can take advantage of existing sewers and drains through fitting a generally bucket shaped sump container into the sewer or basin fitted with a pump or vacuum boom. In many application sites sewers are placed in a location to be gravity fed by the sloping ground. The sump container has a perimeter sized to achieve a tight sealing fit with the sewer or basin opening with a flexible good sealing gasket (such as a rubber or polymer ring), so that all dispensed cleaning fluid approaching and entering the sewer opening flows into the bucket-like sump container. The sump pump held therein pumps the water to the vehicle for cleaning. Power for the sump pump may be provided by a power supply on the vehicle.

Different invention embodiments include different components, including filtration systems for removing contaminants and otherwise cleaning fluid that is returned to the vehicle so that it can be either safely disposed of or reused. An example filtration system is shown generally at 12 in FIG. 3, and in more detail in FIGS. 4-6. These Figs. include a flow schematic useful to illustrate operation and structure of an example filter system embodiment.

In one example system, the filtration system 12 includes multiple stages of steadily declining filter aperture sizes to remove different sized contaminants stage-wise. A first pre-filtering stage having a relatively large aperture is followed by successive stages having steadily decreasing sizes.

Returned water or other cleaning fluid is communicated through inlet line 34 several screening systems by pumps, then communicated to a first settling tank 20. The tank 20 includes initial basket screens that fit into an entry port of the tank 20, with the screen apertures sized as desired to remove relatively large particles. Within the tank 20 oil absorbent materials (gels, fabrics, granula and the like) may be present to remove hydrocarbons.

From a first tank 20 fluid is communicated to a second tank 21 via a reverse P trap inlet/outlet located approximately 8 inches from the top of the tanks 20 and 21. A reverse elbow is useful to this location since oil and other hydrocarbons are lighter than water and therefore float to the top of the tank, so removing water from a location that is below the surface avoids carrying over fat, oils, greases ("FOG's") as well as other hydrocarbons. These materials can be removed from the tank 20 top through periodic draining, skimming off the top using absorption material and/or coalescing filters or other means Once into the second tank 21 water will be stored for a suitable period of time to settle out more of the solids or particulate matter. The second tank 21 may also contain a series of coalescing filters that attract remove smaller particulate matter, heavy metals, and FOG's or other hydrocarbons.

The second tank 21 also includes a float switch for driving a high head high volume centrifugal pump 25. Controller 36 controls the float switch pump 25. When water levels hit a sufficient level, this pump will transfer water to a cyclone separator 24, which spins solids out and down the sides of the separator 24 to a self purging pump 40. Controller 38 controls the separator 24.

From the second tank 21 water is urged through a vortex valve to introduce ozone to treat heavy metals that made it through all the pre filtering systems and on through a series of 4 sequential bag filters 26 (held in aluminum housings) sequenced from 50 micron (first filter 26), to 35 micron (second filter 26), to 25 micron (third filter 26), and finishing with a 10 or absolute micron filter (fourth filter 26). All filter bags 26 use oil attracting technology to encapsulate even more FOG's and emulsified compounds.

Hydrogen peroxide (H-P) is stored in storage tank 28 for adjusting pH of the thus filtered water as necessary. Metering pump 30 communicates with a pH meter and introduces sufficient H-P to adjust the pH as desired. The water is communicated into the recycled 1500 gal water tank 6 that sits below the filter system 12 on lower level LL. Water from this tank 6 may be stored for later disposal, or may be used for washing once again by transfer into clean tank 4. Used filter bags are removed and disposed of or otherwise cleaned for reuse as is appropriate.

Clearly, many alternatives within the filter system may be used in different invention embodiments. The above example system 12, however, provides a useful balance of particulate and other matter removal together with throughput capacity. This example filter system 12 may be arranged on the upper level UL of a two-level vehicle trailer 2, except for the final 1500 gal. holding tank 6 which is located on the lower level LL to provide improved center of gravity characteristics and for close proximity to the filter system 12.

Various filter system stations and tanks are also arranged to allow for convenient access. Filter media will need to be changed on a regular basis, and settled solids will need to be removed from settling tanks and other filter system stations on a frequent basis. For this and other reasons, tanks 20, 21 and filters 26 are generally arranged about a perimeter of the front of trailer 2 against its walls. Access panels can also be provided to allow for convenient access.

The capacity of the retrieval and filter system 12 will vary with application. In many applications the volumetric capacity will be at least as great as, and in some embodiments greater than, the output capacity of the pressure washers 8 so as to achieve at least a steady state. This is not the case for all embodiments, however, since in many water retrieval and cleaning can take longer than spraying.

Plumbing Technology

Some novel and beneficial aspects of invention embodiments are provided in the unique plumbing arrangement. Some vehicle trailers include two 1,500 gallon clean water tanks 6. A hydrant fill station is provided with a 3-way valve to allow for filling of either of the two 1500 gallon water tanks 6 independently of one another. Back flow prevention technology is provided on the hydrant fill station to eliminate any risk of backflow into a public water system. In one embodiment, an air gap is provided downstream of the hydrant fill port and upstream of the clean water tanks 4. The air gap may be, for example, a 6 to 8 inch air gap with a step down receiver off the tank so that water flows by gravity from the initial fill port into the step down receiver through the air gap to prevent any chance of water or chemical back flow from the tanks. It has been discovered that an air gap offers a highly reliable back flow preventer that has a virtually zero failure rate. This is superior to typical check valves, and allows for vehicles of the invention to be filled using highly selective clean water supplies such as a hydrant or other public water supply that may be subject to regulation on backflow protection to protect the clean water supply. This is an important advantage of corresponding embodiments. The clean water fill port (not illustrated) may be located on a vehicle trailer wall at a location above the clean water storage tank 6 to allow for gravity filling, including across the air gap.

Figure 12:
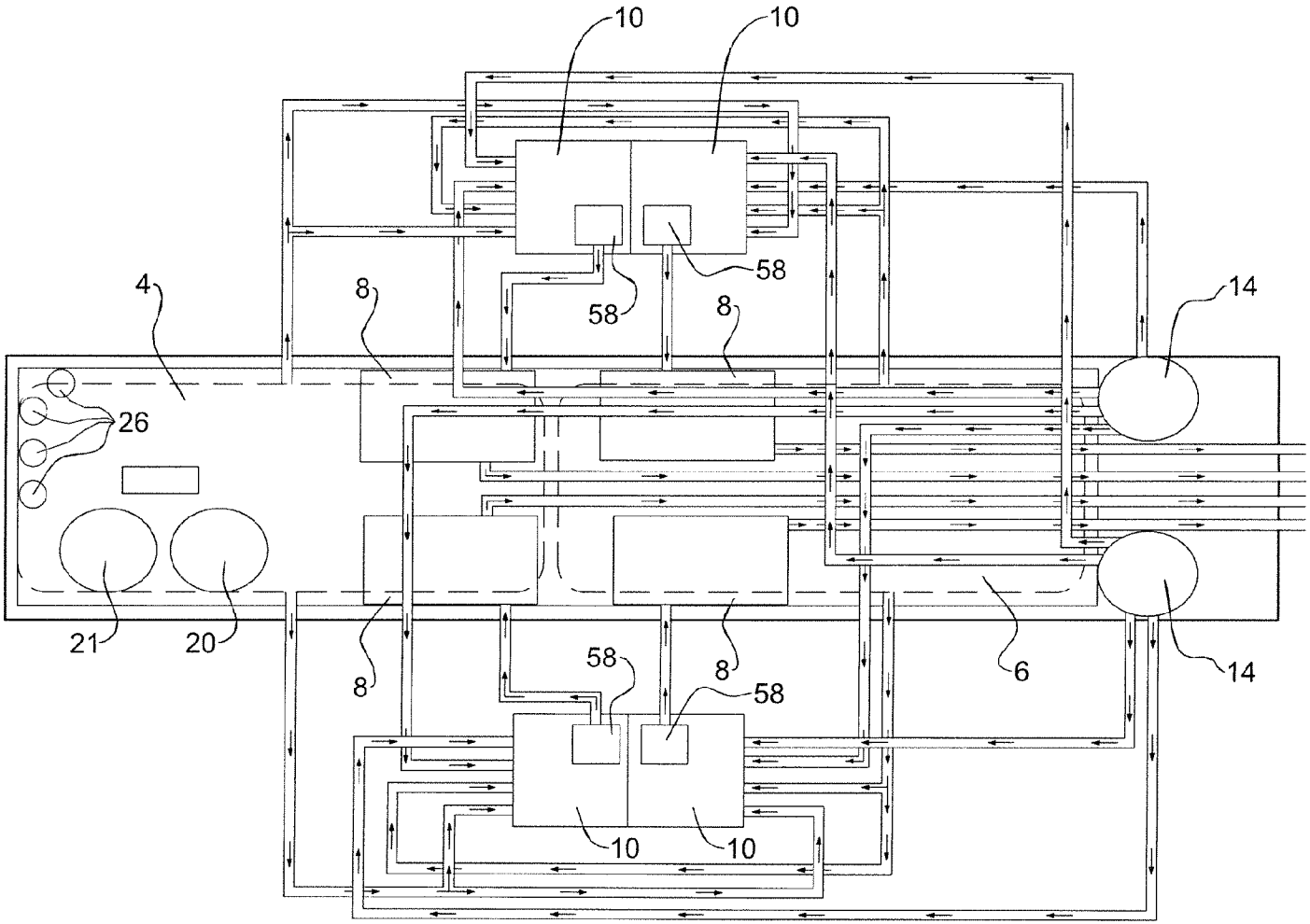
FIG. 12 is a schematic illustration of the plumbing of an example trailer.

Cleaning applications typically require use of detergent or other disinfectants in the cleaning water. Invention embodiments include novel plumbing features for ease of introduction of such materials into the water supply. In some embodiments a 5-way manifold system partly housed in storage cabinet 10 (FIGS. 7, 8, 9) is provided for disbursement of the different types of detergents and materials to be distributed throughout a cleaning or decontamination process. The manifold connects detergent or other chemical supply tanks 14 to water lines where they can be added to the water supply upstream from power washers 8. Various lines and tanks are color coded for ease of assembly, maintenance and operation. One example plumbing arrangement is shown in schematic detail in FIG. 12, including connections between various fluid and other supplies and ultimate outputs and inputs. As illustrated, master controls for all plumbing and fluid control are housed in cabinets 10 for ease of access without necessitating entry into the vehicle trailer 2.

Pressure Washers

Vehicles of the invention also include a plurality of pressure washers 8. Pressure washers 8 have been illustrated schematically as boxes in various Figs., including 3, 10, 12 and others for convenience. It will be appreciated, however, that the pressure washers 8 include components as are generally known in the art, including a pump, heater, valves, connecting conduits, compressors, and the like. The number and characteristics of pressure washers 8 provided in invention embodiments will vary with application and as desired, but in many applications six or more washers 8 are provided capable of generating 3,500 psi pressure and water temperatures of 180° or more with flow rates of 3-10 gpm. Such systems are commercially available from a variety of sources, including Powerline (Riverton, Utah), CamSpray (Iowa Falls, Iowa), Maxus, AR and others. One particular example of a suitable power washer is the Whitco GPO-5030 available from Whitco Cleaning Systems, Inc. (Arkansa). Some systems can operate using cold water input or hot water input, and some units include heaters for heating cold water to hot. Hose reels for storing hoses can be provided on the vehicle roof or walls, with quick connect couplings provided for ease of connection to washers. Step up pumps with float or other automatic switching can be provided to keep the pressure washers primed.

Power Supply

In many embodiments, the pressure washers, pumps, heaters, ventilation systems and other powered components are powered by diesel or propane. Although electric can also be used, in many applications external power supply is not available, with the result that a completely self-contained system with its own power supply offers advantages. One or more diesel generators can be provided in the vehicle or vehicle trailer that generate AC or DC power supply for other components. Or, the truck engine can be used. In many embodiments, however, generators in the trailer are preferred so that the trailer can be a self-contained operation, without requiring a truck. This also allows, for example, a single truck to deploy multiple trailers on a job site. In some embodiments a generator can be mounted below the trailer interior to avoid creating excess heat within the trailer interior.

In such embodiments an optional external input for AC or DC power supply can be provided so that external power can optionally be used when it is available. In other embodiments some components are self powered, with an example being pressure washers that may be diesel driven. If located in the vehicle trailer interior 2, exhaust for the diesel generators or other powered components is routed through the roof of the vehicle.

Electronic Control

Some embodiments include a central control panel that operates all components of the system. Controls can be provided to this single control panel to, among other things:

- Monitor and control each power washer, including temperature, pressure, and flow rate
- Monitor and control spent water intake, including flow rate
- Monitor and control filter system, including opening and closing various valve and turning pumps on or off to control flow rate and direction
- Monitor fluid levels in clean water supply tank, spent water recovery tanks, and filter settling tanks
- Monitor and control generator(s) operation
- Monitor and control soap or other chemical supply and application The control panel may be located within the vehicle trailer 2, on an externally accessible portion of the vehicle (with an example being cabinet 10), or may be portable. In some invention embodiments, for example, software is provided so that controls can be done remotely over a wireless connection. Operation can be executed from a portable computer or other portable processor based device, such as a tablet or smartphone, that is in communication with a second computer or other processor based device on the vehicle that is linked to components as necessary to affect monitor and control as outlined above. Remote operation over a network is also contemplated, with a first client computer located on the vehicle and linked to components in communication with a remote server computer over a wired or wireless network for remote operation or monitoring. As an example, a remote operator can utilize wireless or wired communications to cause a computer to operate valves, pumps, heaters, and other components on the vehicle.

Ventilation Systems

Vehicles of the invention also feature unique ventilation systems. All equipment in the vehicle creating emissions is vented out a roof vent using draft diverters. Ventilation fans are provided to remove and regulate heat inside the vehicle for safety as well as functionality. These fans can be operated to pull fresh air into the vehicle trailer through intake vents V (FIG. 9) communicating with the exterior and to exhaust warm air from the trailer to the exterior through other outflow vents. This can be important since operation of many components will generate heat, with the fans useful to dump the heat and maintain a useful operating temperature in the vehicle. Heating and/or air conditioning can be provided if desired.

Figure 2:
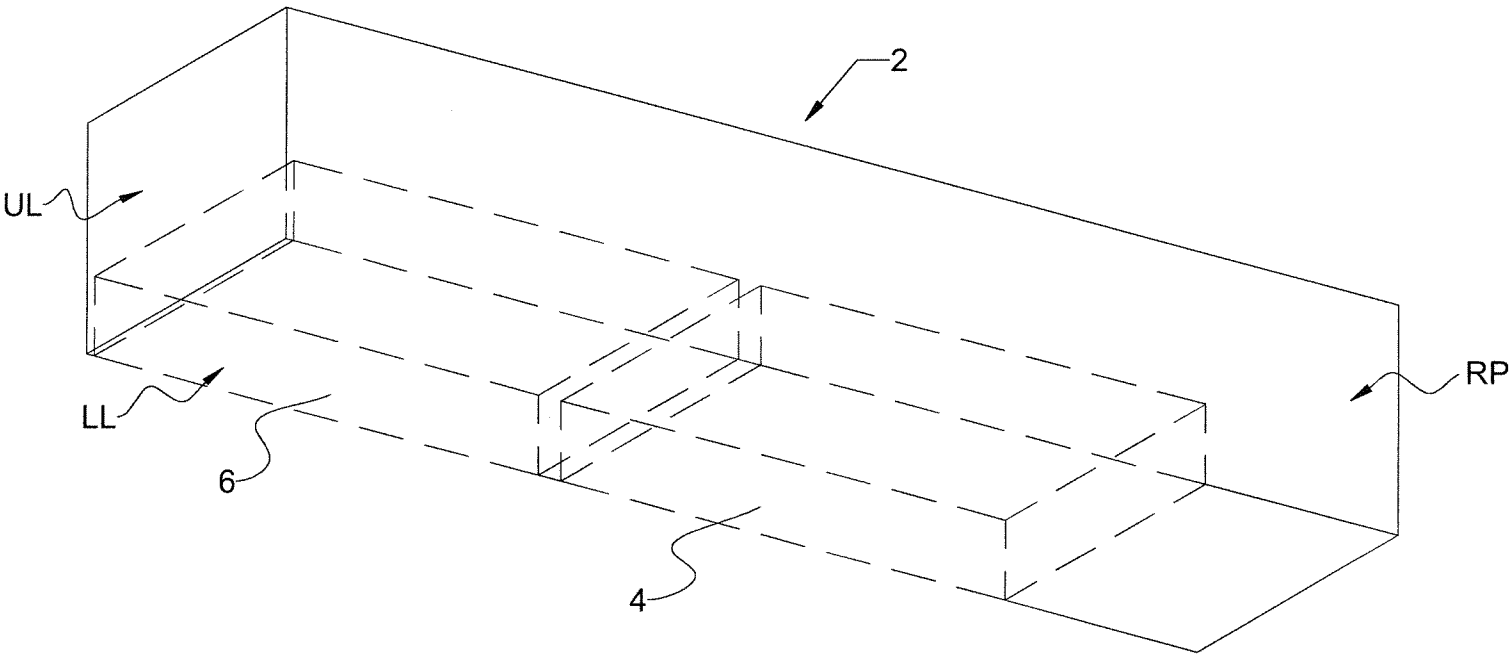
FIG. 2 includes a perspective view of an example trailer as well as a schematic illustration of the same.

Although various aspects of example invention embodiments have been discussed and illustrated above, for sake of completeness further discussion of various aspects of some example embodiments are described below once again referencing the attached Figures. FIGS. 1 and 2 are schematic perspectives of a semi trailer 2 illustrating placement of water tanks 4 and 6 on lower level LL. Again, the trailer 2 may be a standard semi-trailer for sake of cost and standardization. An overhead door may be at the rear for access, and one or more side access doors D (FIG. 9) or panels provided on each lateral side and located as desired. In addition to access, these can be useful for ventilation purposes. In the example embodiment, a rear tank 4 is provided for holding 3,000 gallons of clean water and a front holding tank 6 of equal size and dimensions is provided to store and or reuse recycled water. In other embodiments, two, three or more tanks for each of clean and returned water may be provided. In some embodiments tanks 4 and 6 may communicate with one another through a valved conduit connection, and in some cases with a pump provided to selectively urge filtered returned water from holding tanks 6 back to tank 4 for re-dispersement.

It has been discovered that locating rear tank 4 near the lengthwise center of the trailer 2, with the holding tank 6 near the front of the vehicle trailer 2 offers advantages in fuel efficiency and handling of the vehicle when transporting it. The rear tank 4 is often filled while traveling to a jobsite, while the holding tank 6 is not. Likewise, placing tanks 4 and 6 forward in the trailer with some space left open behind them along the length of the trailer 2 has been discovered to increase fuel efficiency and driving handling.

Likewise, it has been discovered that distributing the weight of the fluid over substantially all of the width of the vehicle also benefits fuel efficiency and handling. For these reasons, tanks 4 and 6 extend across substantially all of the vehicle interior.

As shown, the tanks 4 and 6 are rectangular shaped, with a footprint and planar walls to match those of the vehicle trailer. This has been discovered to offer maximum efficiency in terms of using available space in the vehicle trailer 2. The tanks 4 and 6 are also sized equally since clean water originally in tank 6 will ultimately be stored in the recycled water holding tank 4.

Polymer construction tanks are used in many embodiments to provide a favorable weight profile while maintaining suitable strength and durability. By locating these tanks 4 and 6 within a trailer 2 interior, useful advantages and benefits are achieved. In prior art examples a tank may be exposed. Although exposed tanks can be used in various invention embodiments, arranging tanks internal to a vehicle trailer as shown in FIGS. 1 and 2 offers many advantages in at least some applications. As an example, a lighter weight polymer tank construction can be used since the tanks 4 and 6 are not exposed to the environment during travel or on location at a jobsite. Tanks 4 and 6 are mounted using underlying stop plates that are connected directly to the trailer frame for enhanced support. Tanks 4 and 6 are then strapped to the trailer walls, frame and other supports using cargo straps. Other mounting and attachment elements can be used.

Figure 3:
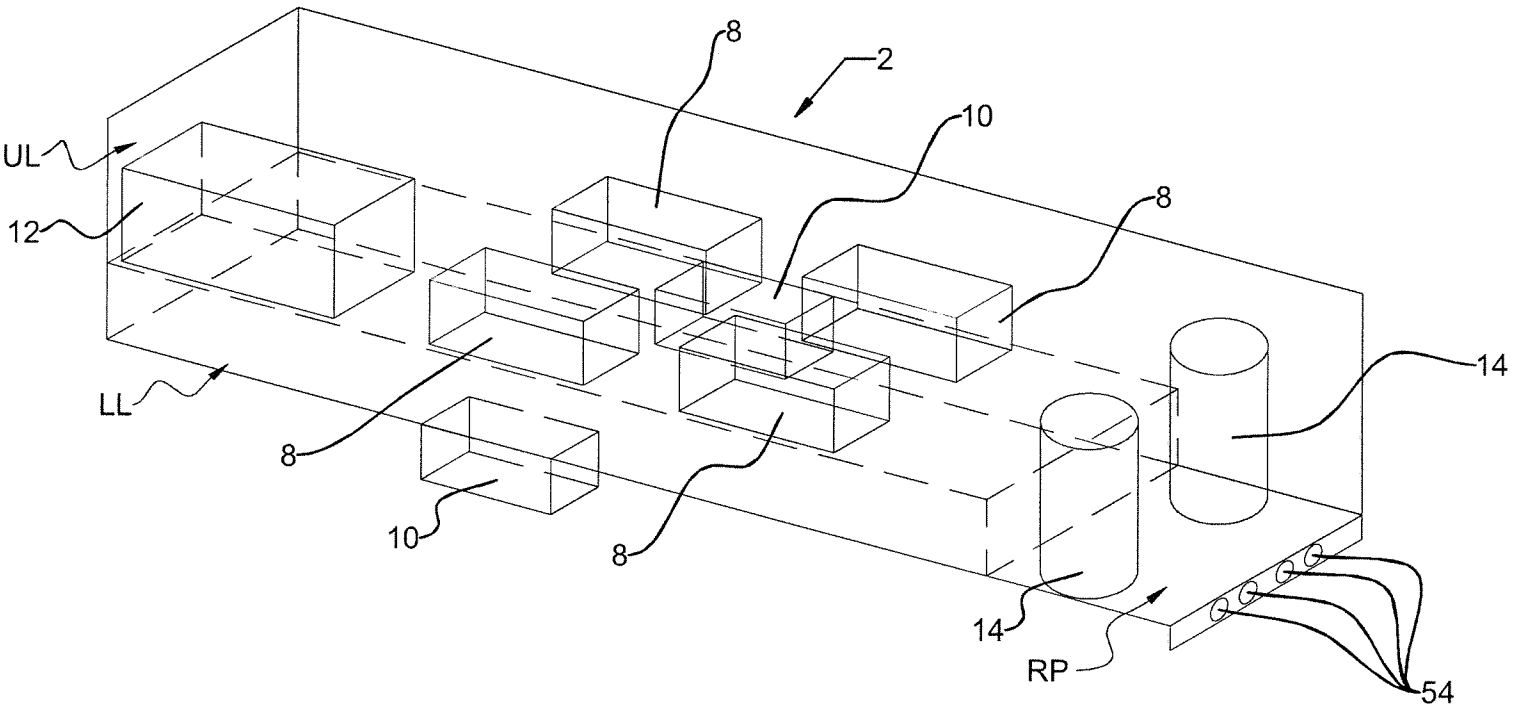
FIG. 3 includes a schematic illustration of an example trailer with various components included.
Figure 4:
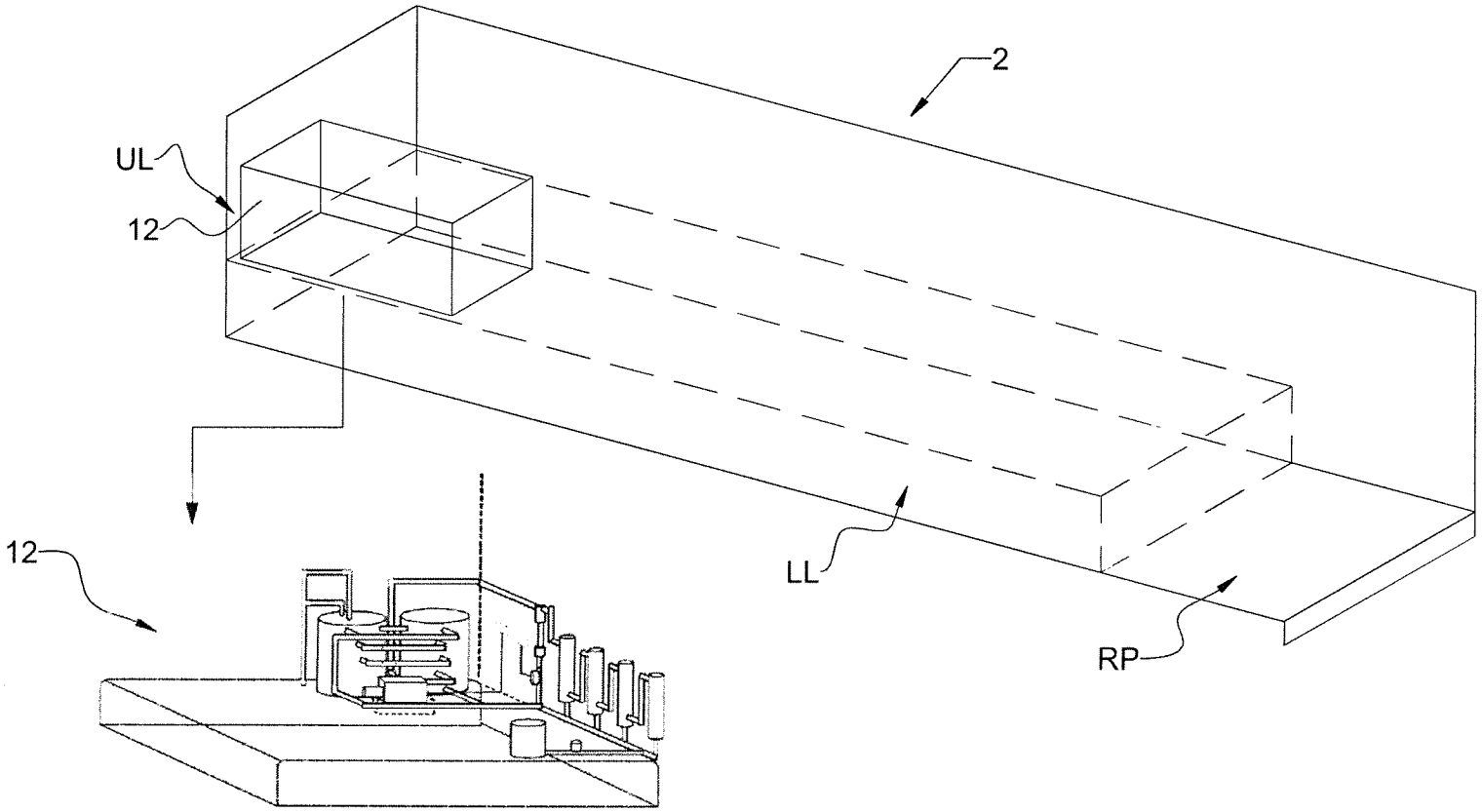
FIG. 4 includes a schematic illustration of an example trailer with a filtration system exploded for illustration.

FIG. 3 is a schematic perspective showing the arrangement of some components within the trailer 2 on the upper level UL, above the water tanks 4 and 6. In this example embodiment, four pumps or pressure washers 8 are provided and arranged opposite one another along side walls of the trailer 2, and generally towards the center lengthwise of the trailer 2. This provides favorable weight distribution for good vehicle handling and fuel efficiency when transporting the trailer 2. Manifold cabinets 10 are placed below the lower level on the exterior of the trailer 2 for controlling pressure washers 8.

The filtration system generally shown at 12 is arranged towards the front of the trailer 2 above the recycle storage tank 6. This is described in detail in FIGS. 5 and 6 as discussed above. Detergent and degreaser tanks 14 are located near the rear of the trailer 2. In this portion of the trailer there is no two level deck arrangement, but instead a single full height portion referred to as the Rear Portion or RP in various Figs. for convenience. The rear portion RP consumes the height of the trailer 2, and has a length that is much less than those of the upper level UL and lower level LL. Cylindrical tanks 14 are vertically mounted in rear portion RP. Four output or discharge ports 54 in communication with all pressure washers 8 are located at the rear of the trailer 2 and underneath the trailer floor for connecting to hoses for dispensing at a jobsite. Plumbing connecting the pressure washers 8 and output ports 16 is located below the trailer 2, or along its floor, and is illustrated in schematic detail in FIG. 12. It has been discovered that this configuration offers benefits and advantages over prior art arrangements.

The full height rear portion RP of the trailer together with rear access doors provides for good storage space where hoses, nozzles, shovels, brooms, mops, buckets and other job site tools may be stored (hoses on mounted reels, for instance). It has been discovered that arranging pressure washer discharge ports 54 here allows for convenient access to hoses and valves for fast and efficient connection when at a jobsite. Valuable cost and time savings are therefore achieved.

Figure 5:
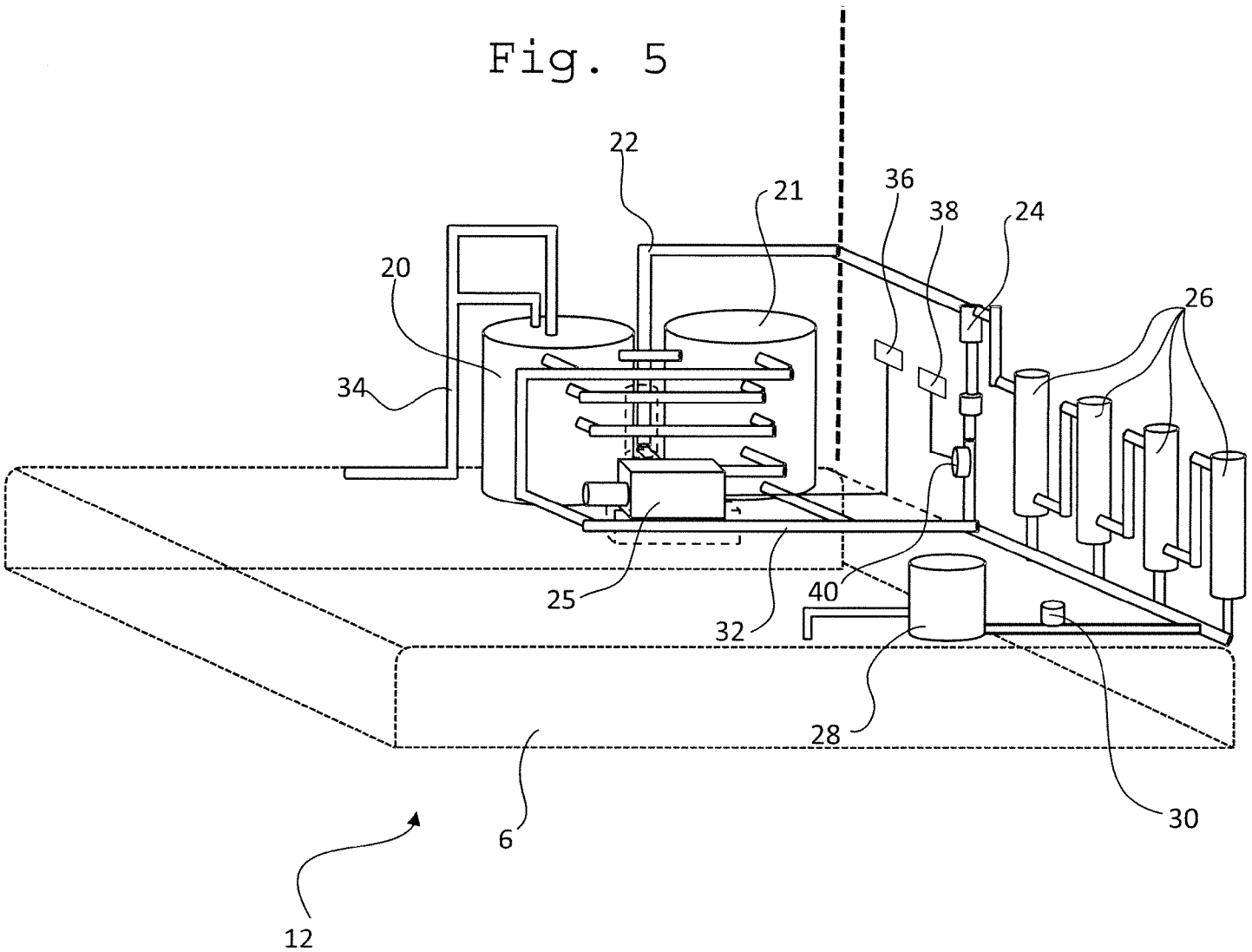
FIG. 5 is an expanded view of the filtration system of FIG. 4 in greater details.
Figure 6:
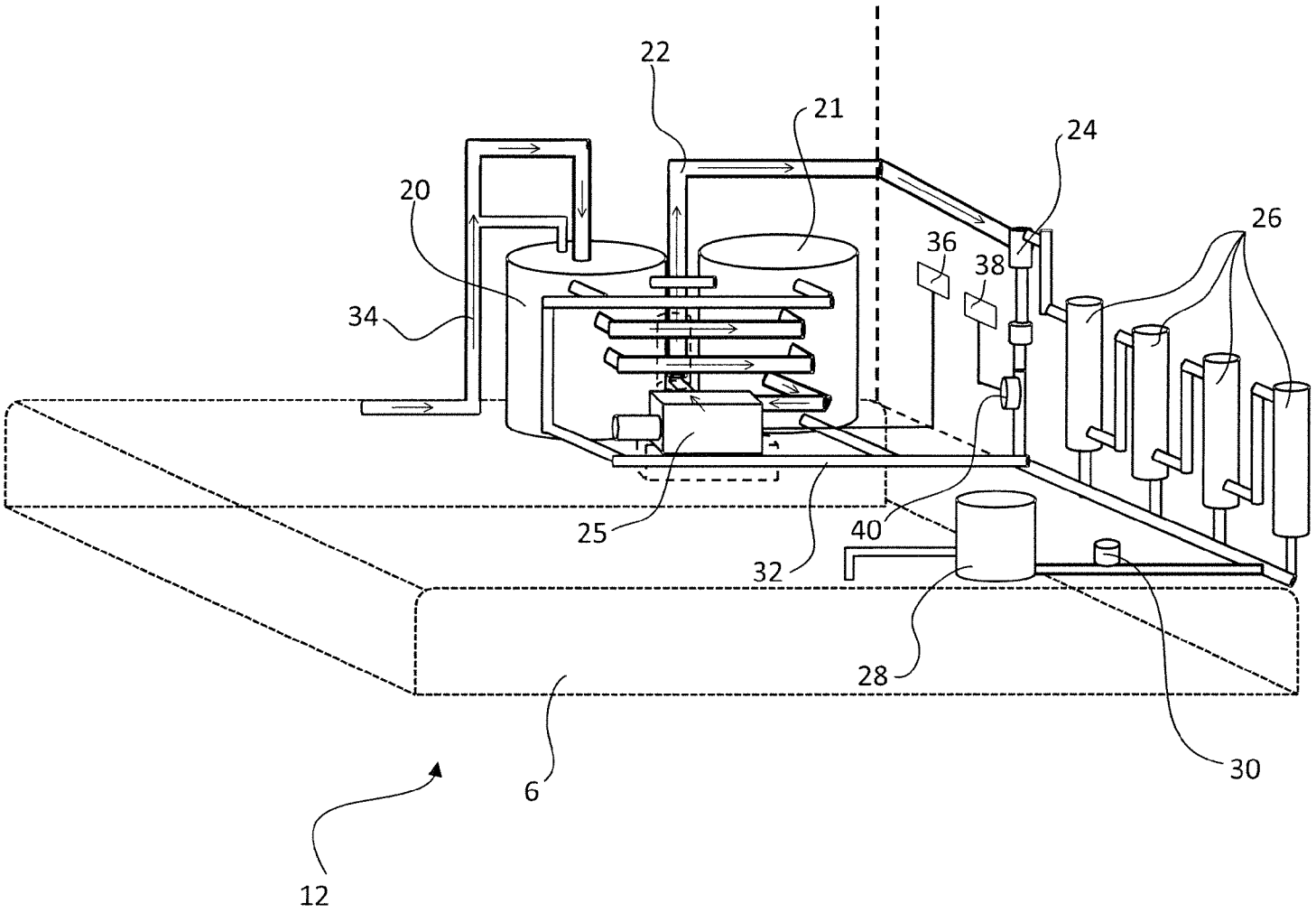
FIG. 6 is an expanded view of the filtration system of FIG. 4 in greater details.

As discussed above, FIGS. 4-6 schematically illustrate the filtration system 12. FIG. 5 is similar to FIG. 4 except that arrows have been provided to indicate direction of flow. First settling tanks 20 receive incoming water and are fitted with screens and hydrocarbon absorbers as discussed above. Water is removed from the settling tanks 20 and 21 via line 22 and communicated to a centrifugal cyclone separator 24. A series of increasingly fine bag filters 26 follows, with filter sizing set as desired. A series of 4 filters has been illustrated, and are mounted on a front trailer wall. In the example embodiment, these filters are set at between 50 and 10 microns steadily decreasing as the fluid travels through the series (e.g., 50 microns, 35 microns, 20 microns and then 10). Water is communicated from the final filter 26 to the recycle storage tank 4.

Additionally, a hydrogen peroxide or other water treatment material storage tank 28 is provided and in communication with the tank 4. A flow meter 30 controls flow. This can be useful to further cleanse the recycle water in the tank 4, and to adjust its pH or other physical property through metered addition of treatment material from tank 28. The flow meter 30 may be controlled by a meter measuring the pH or other physical property of the water in the recycle tank 4, so that pH or other desired physical property is measured and controlled automatically. In some embodiments, water from recycle tank 4 is clean enough to equal that of tank 6 and can be reused as clean water for spraying. In such cases, tanks 4 and 6 are in communication with one another via a conduit, valve, pump and other components for control.

The filter system 12 further includes a sediment removal line 32 communicating with the first tanks 20 and 21 and each of the bag filters 26. As indicated, the removal line 32 communicates not only with the bottom of the first tanks 20 (to remove heavy sediment) but also with the top fluid level to remove FOG's and other light hydrocarbons that have floated to the top of first tanks 20.

Figure 7:
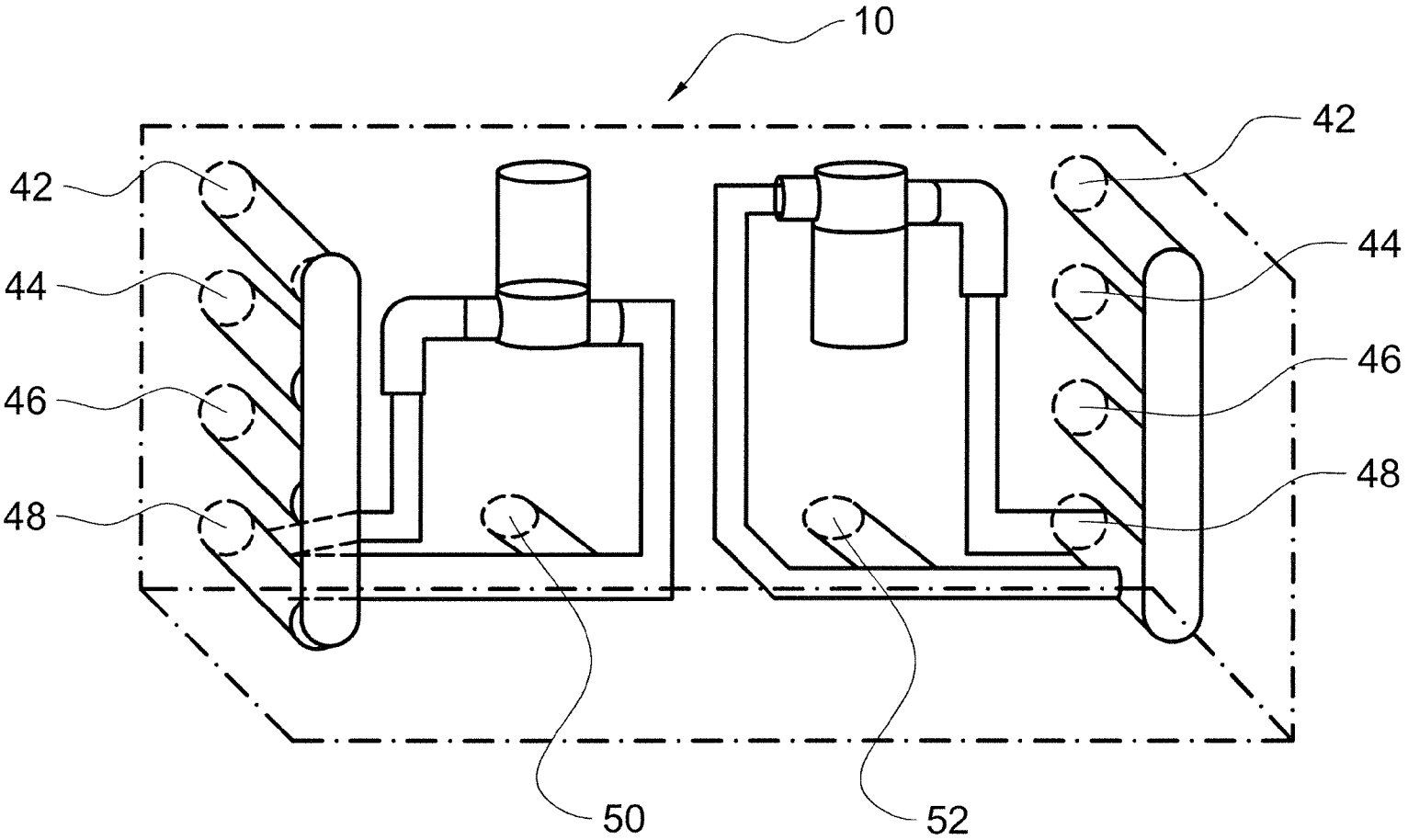
FIG. 7 is a schematic view of an example manifold cabinet and manifold arrangement contained therein.
Figure 8:
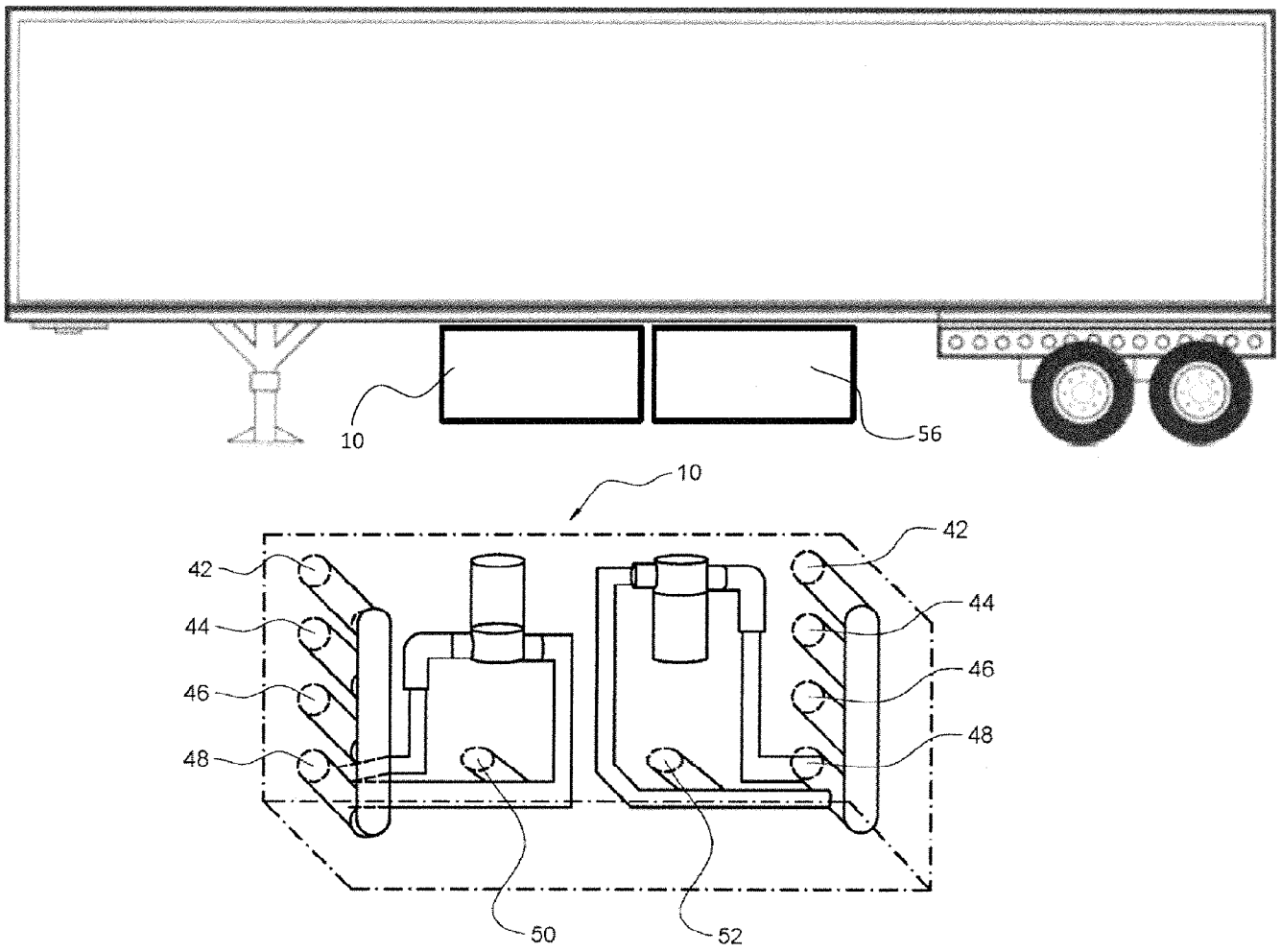
FIG. 8 is a schematic view of an example trailer with manifold cabinet and manifold arrangement contained therein.
Figure 9:
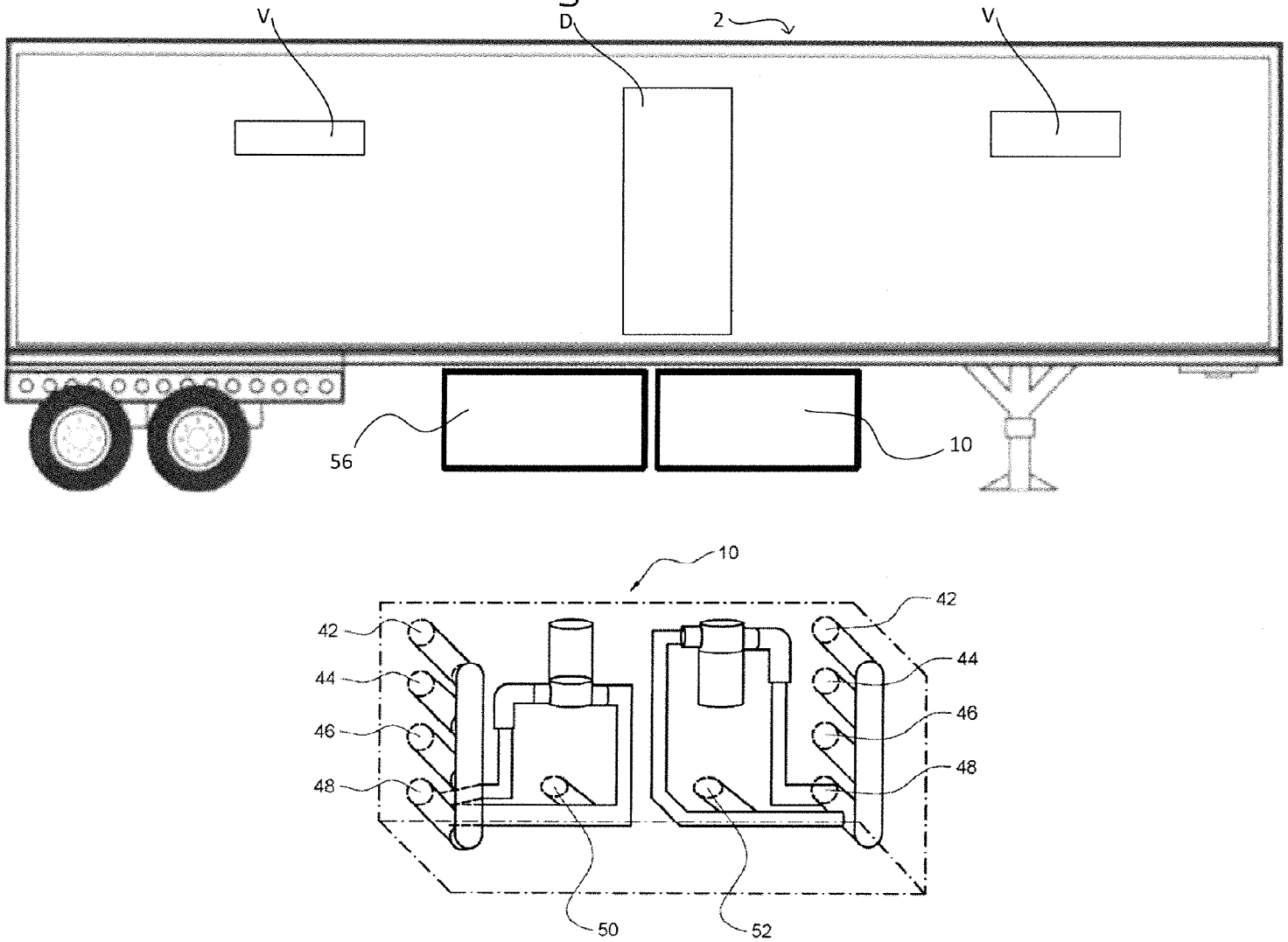
FIG. 9 is a schematic view of an example trailer with manifold cabinet and manifold arrangement contained therein.
Figure 10A:
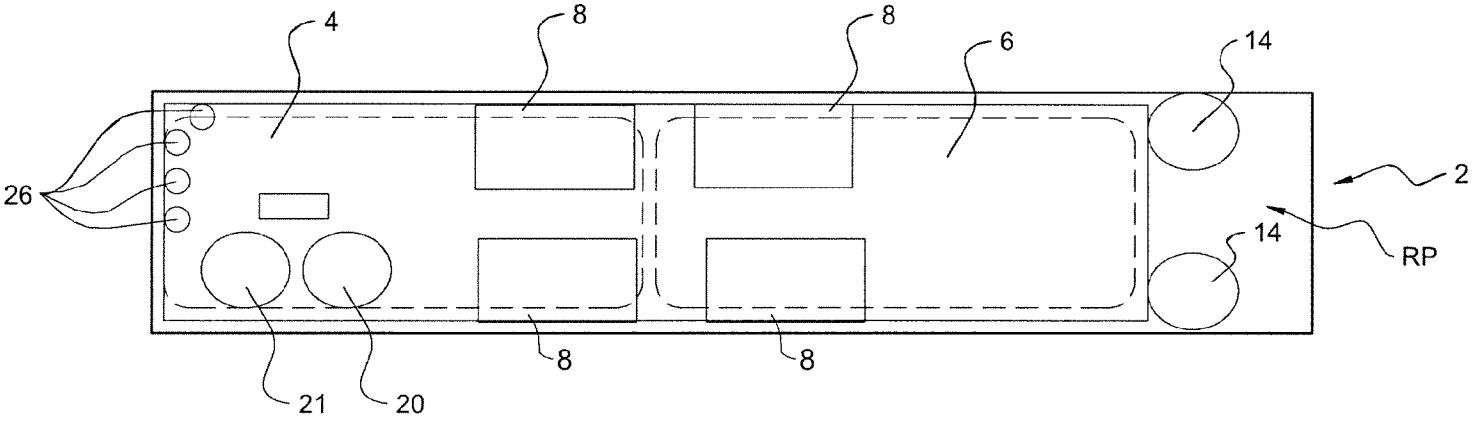
FIGS. 10A and B are top and side schematic views of an example trailer.
Figure 10B:
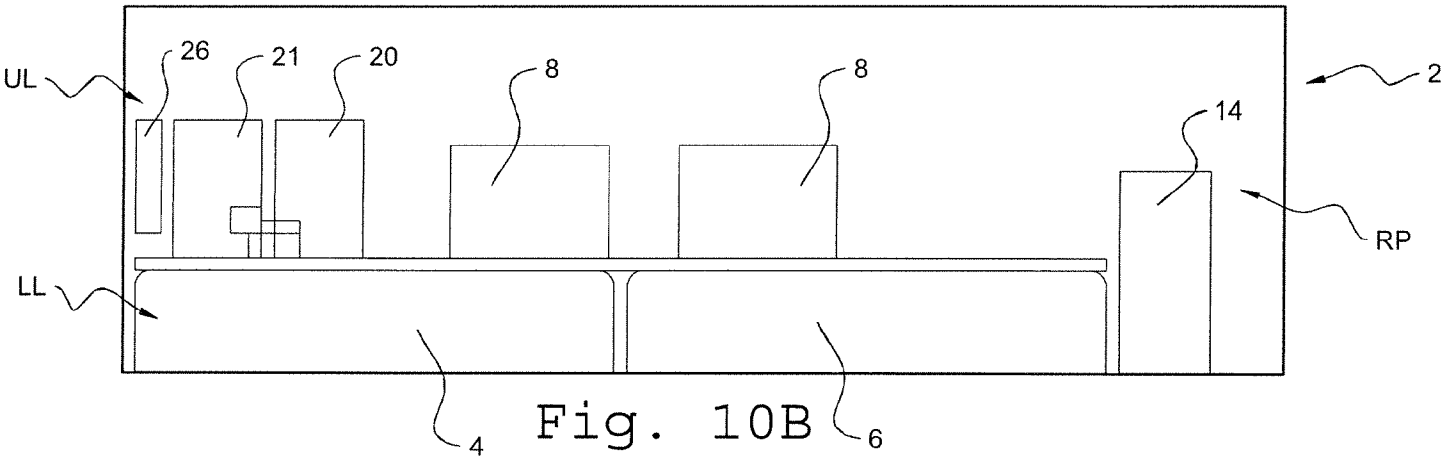

FIG. 7 schematically illustrates manifolds 10, and FIGS. 8-9 show its placement. As shown, they provide easy access from external to the trailer 2 for controlling flow quality, composition, and quantity. FIG. 9 also illustrates a side access door and vents on the trailer 2. Any number of these can be provided in sizes, placement and otherwise as desired. A rear access door is particularly advantageous in some embodiments. FIGS. 10A and 10B show a top perspective schematic and a side elevation schematic, respectively, of the layout of the example trailer 2. As viewed in FIG. 10A, space is left for a walkway down the center of the trailer interior for ease of access. As also evident in the FIGS. 10A-B, significant space remains in the trailer 2. This will be used to house various pumps, controllers, and other components not illustrated in the Figs. As an example, intake pumps may be located on the upper level UL for communicating water to the filter system 12. As another example, one or more central computers can be provided that are linked to some or all of the components (including pumps, valves, heaters, and others) for providing control and monitoring capability.

The central computer may include a display such as a monitor, one or more volatile and non-volatile memories, data input devices such as a mouse and keyboard, and communications links for communicating with a network such as the internet, an intranet, a wireless phone network, or other. The communications may be wired or wireless. This configuration may be particularly advantageous to provide for remote operation and/or monitoring of some or all components.

As an example, an operator may be present at a jobsite and performing basic operation of the vehicle components, with a remote office remotely monitoring the same via a central computer and remote communications link. The remote office may monitor various maintenance features as well, with examples including dates of replacement or servicing of various components. Sensors may be present in all tanks, pumps, filters, and other components to detect some operational data and report the same to the central computer. As specific examples, tank fluid levels may be monitored and reported, as well as filter volumetric flow rates and/or pressure differentials across filter media to indicate the level of blockage of the same. The remote office may be able to monitor these through use of a central computer and alert the on-site operator to various issues such as a filter that requires changing.

In still other embodiments, a central computer may communicate by a wireless technology of limited distance reach for remote monitoring and/or control on the jobsite. Bluetooth technology is one example of a wireless communication that may only reach 10-20 meters. Wired or wireless control may be linked to a second computer in a truck cab, for example, to allow control from a more comfortable and convenient location than the vehicle trailer. Other invention embodiments may also include a wireless audio communications system so that multiple operators can speak with one another.

As also shown in FIGS. 10A and 10B, the upper and lower levels UL and LL do not extend completely along the length of the vehicle trailer 2 (it will be appreciated that the "length of the trailer" refers to the major dimension of the trailer), but instead leave a space along the length near the rear end of the vehicle trailer that consumes substantially the entire height of the trailer interior. This has been discovered to offer useful benefits and advantages, including storage for full height components, tools and the like, as well as access to both the upper and lower levels. As shown in FIGS. 10A and B, two detergent/degreaser/chemical storage tanks 14 have been provided. These tanks 14 may be connected by a conduit to one or more of the pumps, pressure washers 8 or other components in the vehicle.

FIG. 10B shows dimensions of one example embodiment. Dimensions may change in other embodiments, but these have been discovered to be particularly useful in many applications. As discussed above, the relative heights of the lower and upper levels, for example, represent good balances between too much and too little space.

The decking that separates the lower level LL and upper level UL may be removable planks, panels or the like made of wood, metal or other material. They may be removable to allow for access through the floor. One or more removable access doors or panels may also be provided in the decking, as well as wells or other passages. These allow for access between levels, as well as for passage of fluid, power, or other lines or conduits between the levels. Decking may be securely fastened as necessary to ensure good mounting of components for safe travel and operation. Aluminum, steel or other materials may be used to construct a frame on which the decking is attached. The frame is securely attached to the vehicle trailer floor, walls, or frame using bolts, mounting brackets, welding or other fasteners, which may include DOT interlocking intermodal channel locking bars.

Figure 11:
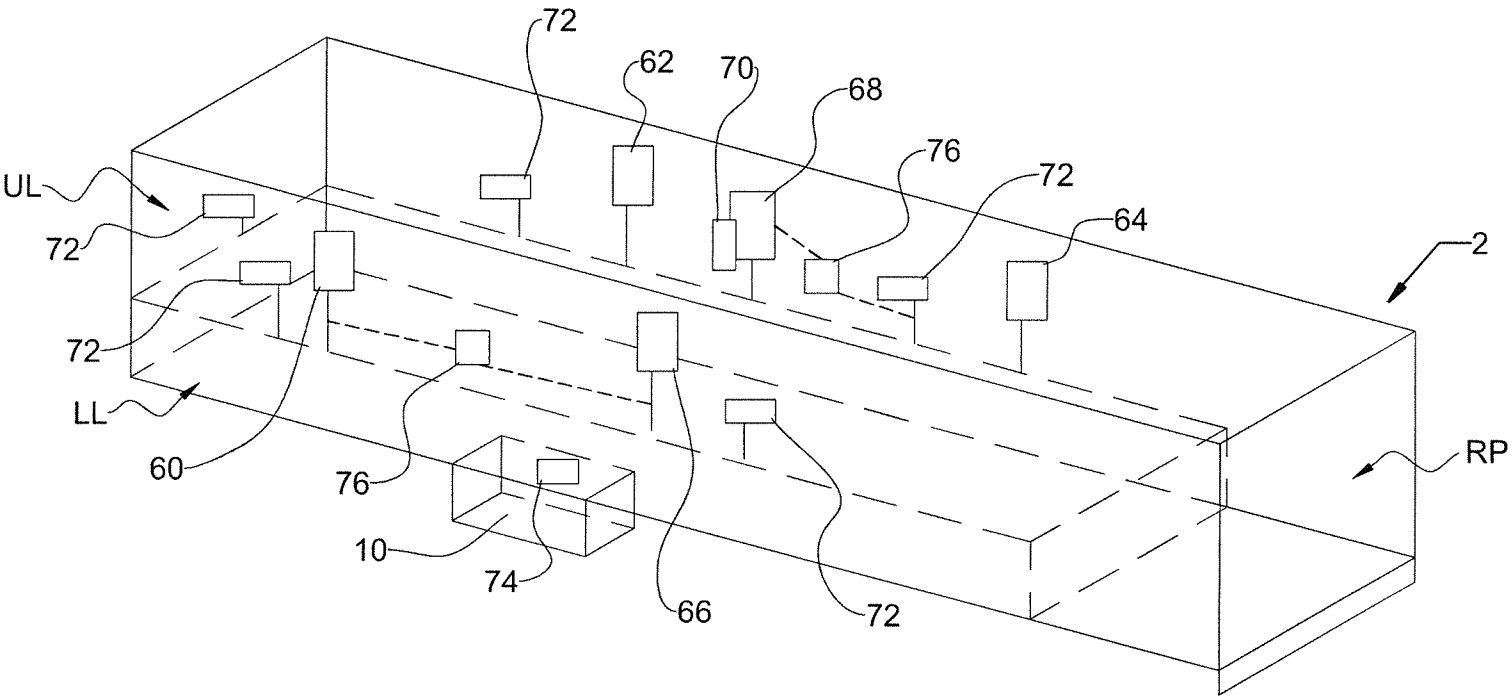
FIG. 11 is a schematic view of an example trailer with various electrical components shown schematically.

FIG. 11 schematically illustrates a power circuit for the trailer 2. Multiple power lines, switches and power outlets are provided to supply various pumps, pressure washers 8, and other components. Power is carried by electrical lines in conduit or other protective material along trailer walls, floor, ceiling or the deck. In one embodiment, power lines are carried immediately below the deck and above tanks 4 and 6 for ease of installation and maintenance. As discussed above, FIG. 12 is a plumbing schematic that illustrates fluid connections between various components with control located in cabinet 10. Connections may be made using PVC lines, flexible hoses or other conduits, with valves provided as desired. Solenoid valves may be provided to facilitate remote valve operation. In one embodiment, fluid lines are carried immediately below the vehicle 2 bottom wall for ease of installation and maintenance.

Figure 13:
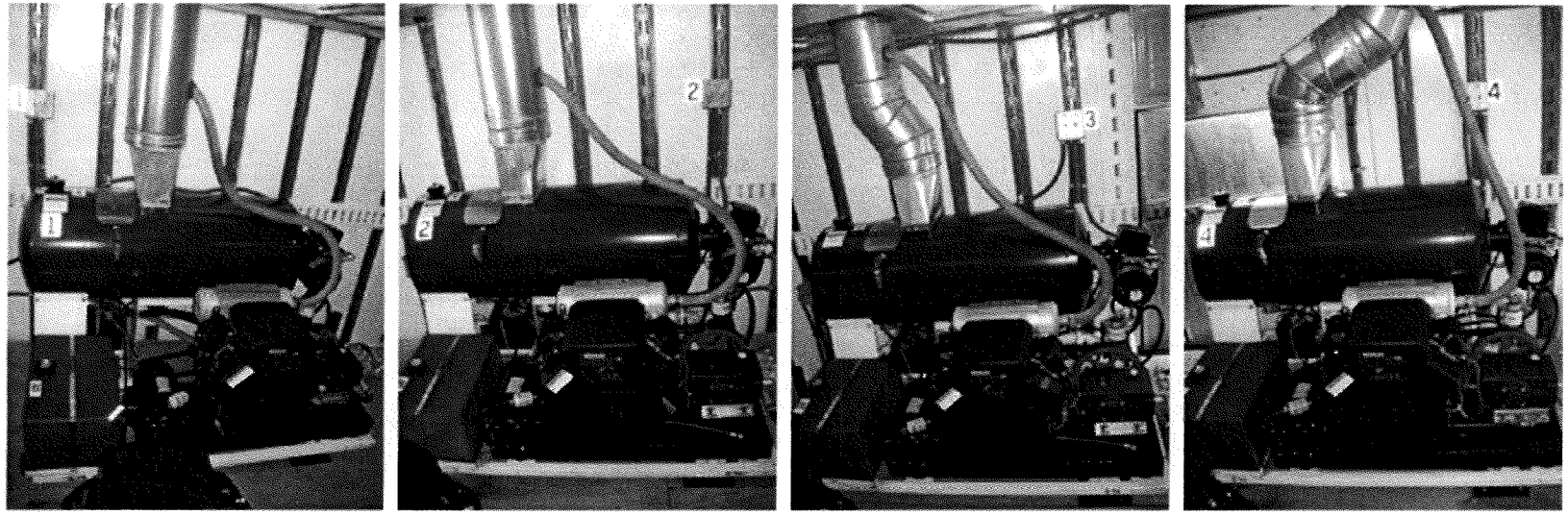
FIG. 13 includes depictions of an example trailer interior.
Figure 14:
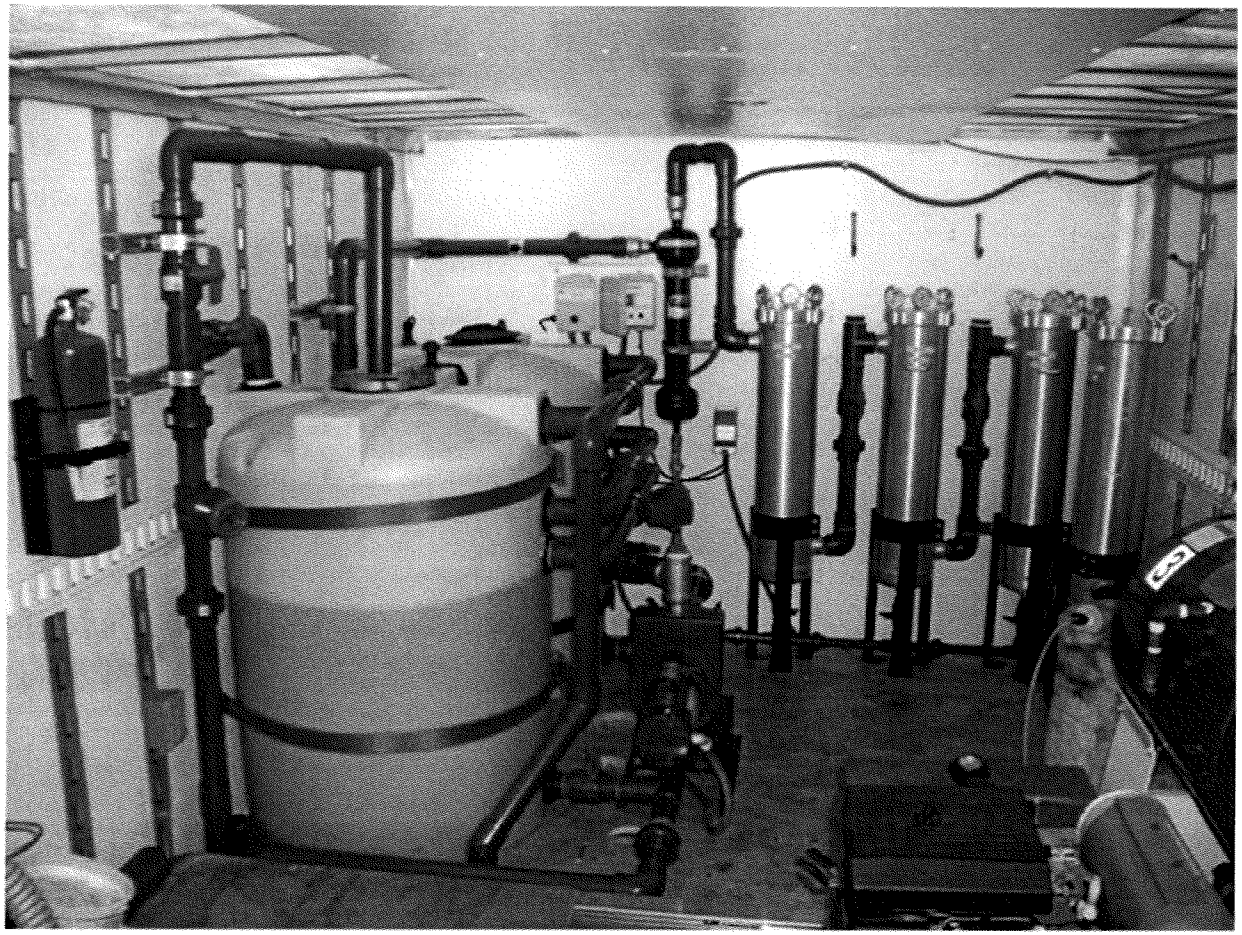
FIG. 14 includes depictions of an example trailer interior, including various components of a filter system.
Figure 15:
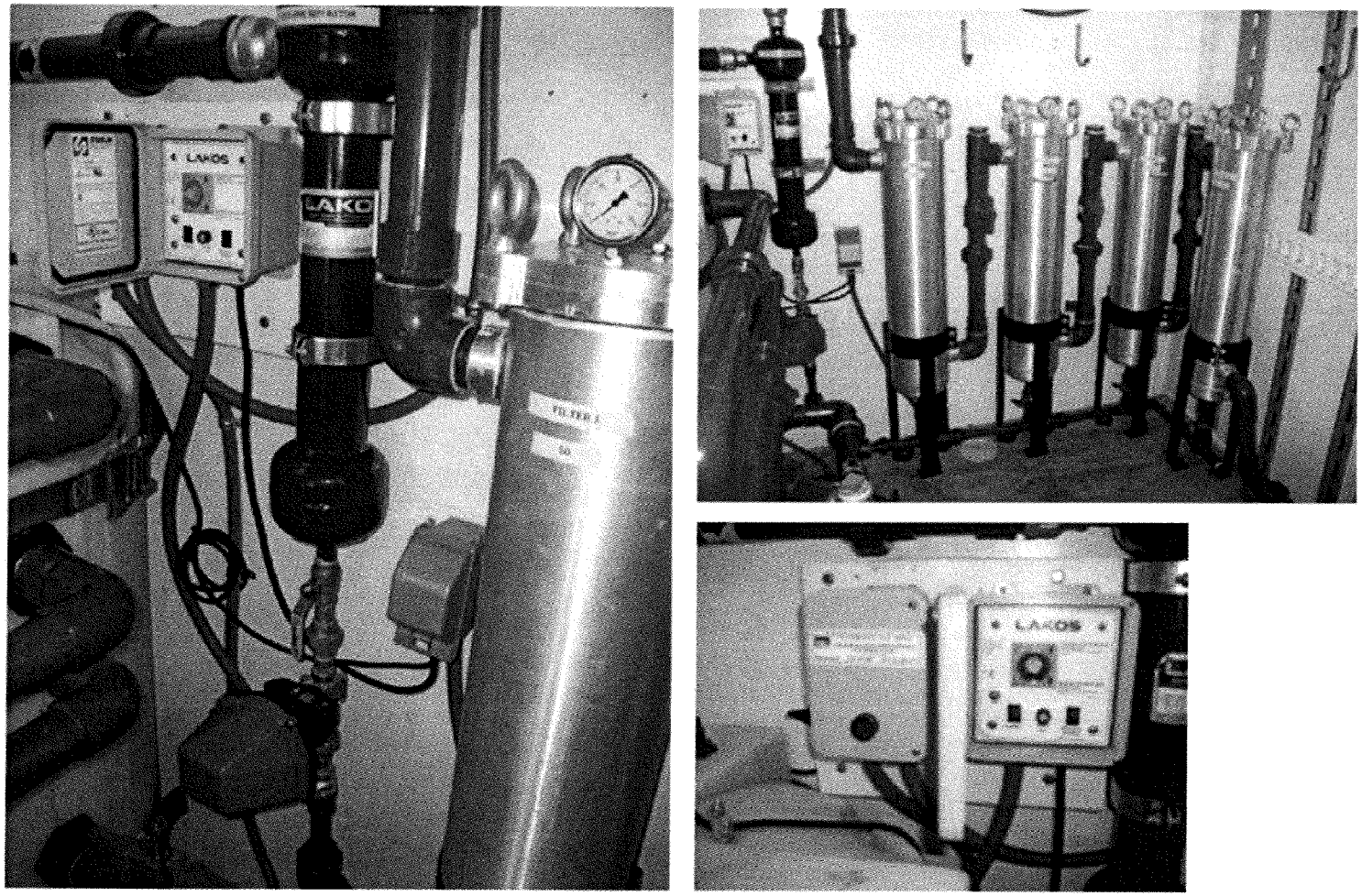
FIG. 15 includes depictions of an example trailer interior, including various filter system components, some of which are also shown in FIG. 14.

FIGS. 13-15 show photographs of an example embodiment. Various components are shown as illustrated. FIG. 13 shows four pressure washers. As illustrated, they may be mounted on the planking separating levels, and firmly attached to vehicle walls. Power washers are generally known and need not be discussed in detail for sake of brevity. They may include one or more pumps, which may be piston or other positive displacement pumps suitable for generation of sufficiently high pressure. They may also include a heater or heat exchanger for heating fluid.

In the photos shown, an exhaust pipe from the heater travels upward for venting through the vehicle roof. A common vent may communicate with all four pressure washers.

Pressure washers 8 can be obtained commercially to achieve desired temperature, pressure, and volumetric flow. In some examples, pressures of 3,500 PSI or higher are useful, with flows of 6-10 GPM (per washer) and temperatures of up to 180° or more. One example is the Whitco GPO 5030, which includes a 5 GPM capacity, 3000 PSI rating, 1.5 HP burner motor, and 18 HP pump motor. As discussed above, soap or other detergent may be supplied in a composition as desired.

Figure 16:
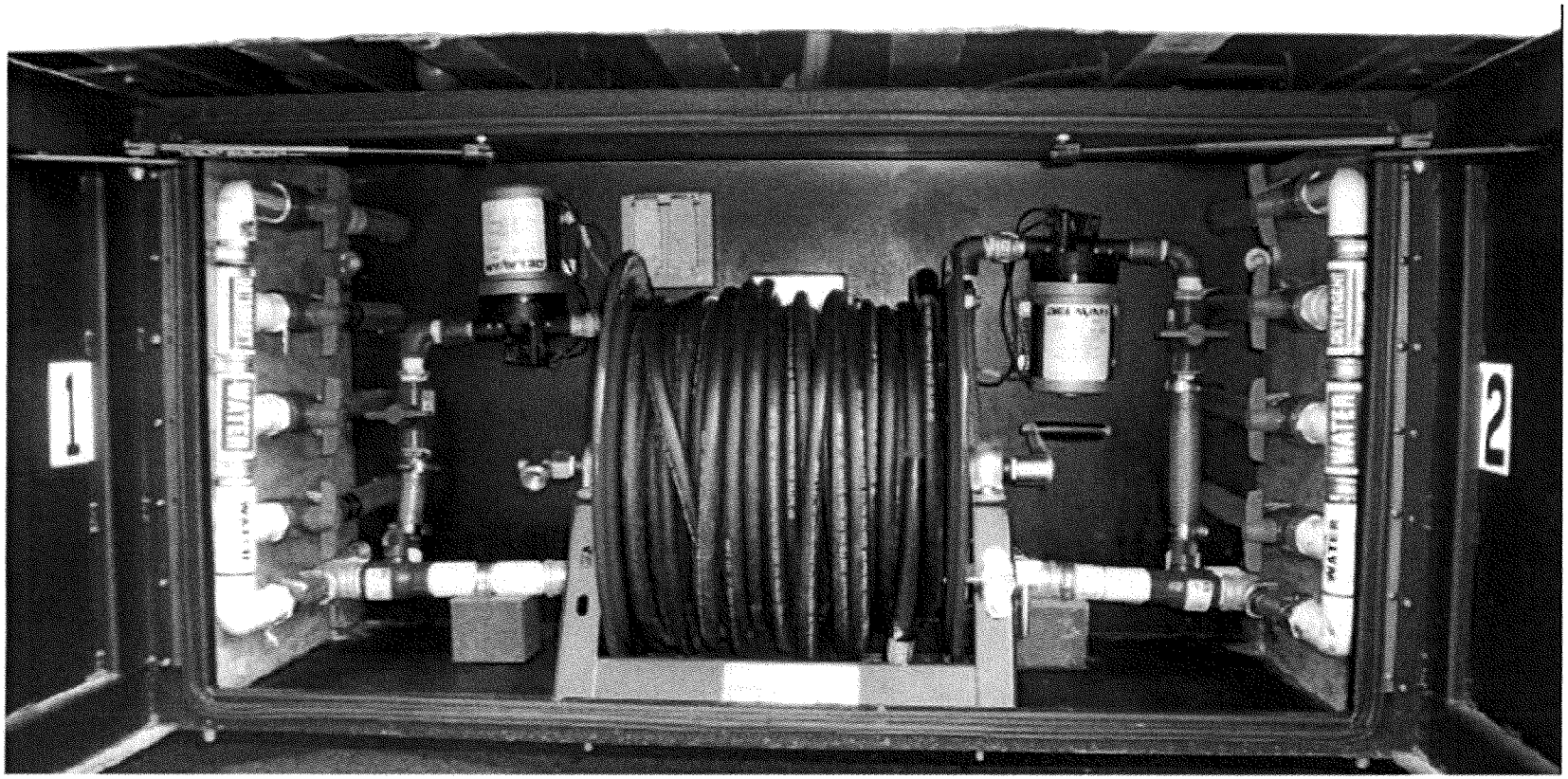
FIG. 16 is a depiction of an example trailer storage cabinet with a spray hose disposed therein.

FIGS. 14-15 depict various features of an example filtration system 12. Again, components are attached both to the deck and to the vehicle walls, and arranged to allow for ease of access for operation, maintenance and replacement. Attachment may be using straps or other supports to an intermodal I channel locking bars of the trailer. FIG. 16 depicts an example cabinet 10 interior, with a hose reel storing hose in the center and various valves and controls of a plumbing manifold arranged along the sides thereof.

Figure 17:
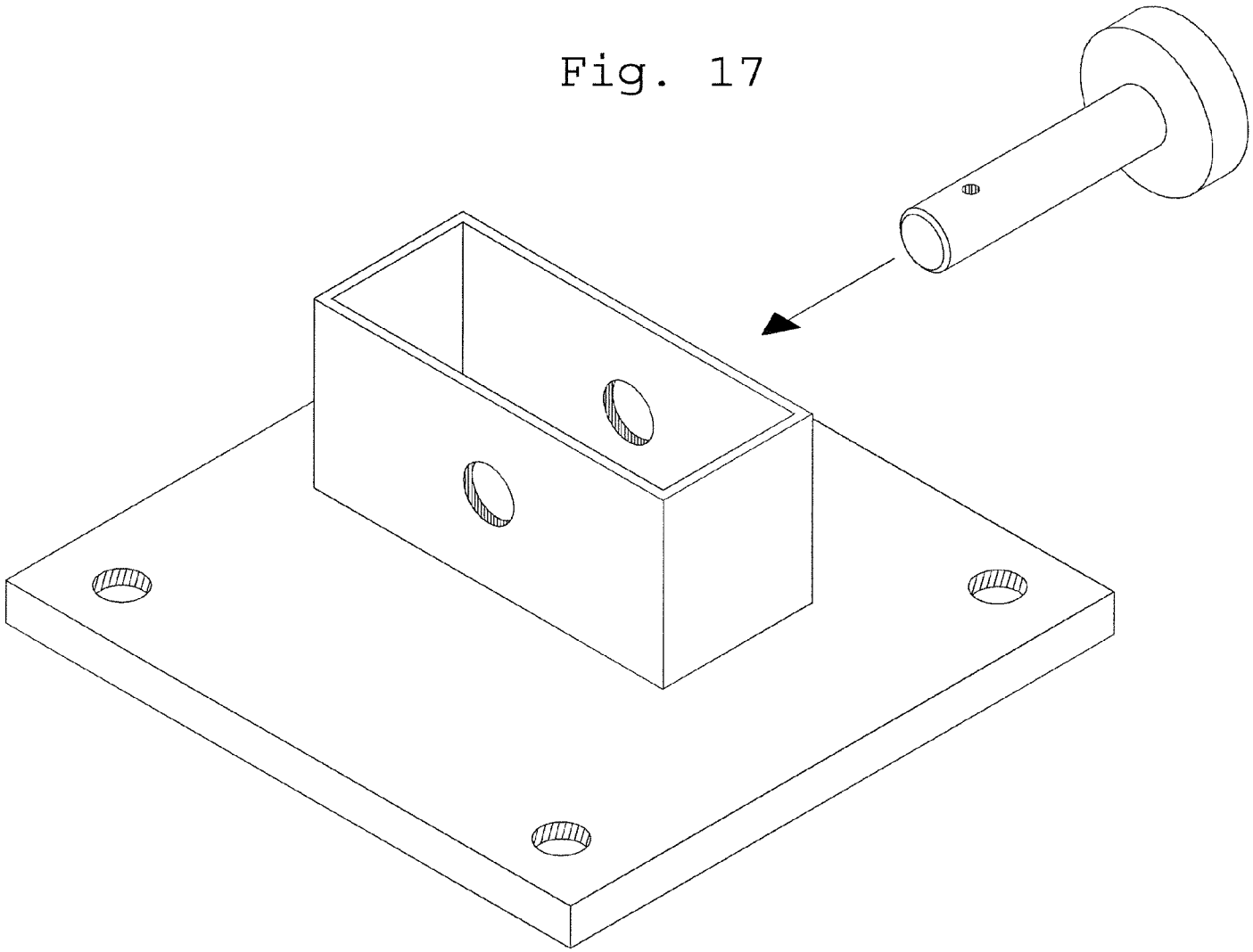
FIG. 17 illustrates a quick connecting mounting base.

FIG. 17 illustrates still another aspect of some invention embodiments. Various components, including pressure washers 8 and others, may be conveniently installed and removed through permanent and secure mounting on a base platform (such as a skid), which is then quickly installed and removed within the vehicle using quick-connect feet. The quick connect feet may include a receiving portion on the deck which lockingly engages with a cooperating feet lugs on the platform to be mounted. In some examples, the receiving portion has a generally cube or three dimensional rectangular shaped receiving cavity (which may have 4 or three side walls, and an open top) with a passage through at least one and preferably two opposing sidewalls. The feet lugs have a cooperating shape that is inserted into the receiving cavity, with the lugs also having a passage that is coextensive with the receiving cavity passage. A removable locking pin is inserted through the cooperating passages to lock the feet in place.

It has been discovered that this provides a very convenient and efficient configuration for assembly, periodic maintenance, and access. This can be used to mount, among other components, the skid mounted pressure washers 8, various tanks which may also be skid mounted (tanks 14, 20, 21 and 28, for example), and others.

It has been discovered that this configuration offers a very efficient and robust construction. As the vehicle travels about, heavy components that are mounted in the upper level can tend to move about. Mounting such components on skids which are then locked in place on the second level offers a tightly secured mounting, and yet allows for easy and fast removal for servicing or replacement.

Various aspects of invention embodiments have been discussed and illustrated above. It will be appreciated that this has been done in the spirit of exploring some aspects of invention embodiments only, and shall not limit the scope of the invention as claimed. Indeed, those knowledgeable in the art will appreciate that many equivalent features and alternative arrangements are possible and within the scope of the invention as claimed.

What is claimed is:

1. A mobile system for dispensing cleaning fluid at a jobsite comprising:

a vehicle with wheels and an interior and having a first end and a second end;

a lower level provided in the interior;

an upper level provided in the interior and separated from the underlying lower level by a deck wherein the deck is selectively movable and adjustable and wherein the deck contacts the first end of the vehicle but does not contact the second end of the vehicle;

a clean fluid supply tank located on the lower level;

at least one outflow pump downstream from and in communication with the clean fluid supply tank arranged on the upper level;

at least one spray hose for dispensing fluid from the clean fluid supply tank, the spray hose downstream from and in communication with the at least one pump, at least a portion of the at least one spray hose external to the vehicle for dispensing the fluid at the jobsite; and wherein the outflow pump is mounted on a skid and wherein the skid is removably attached to the deck using a plurality of lugs having first passages, the lugs received in mounts on the deck wherein the mounts are cube shaped or rectangular having a hollow cavity with cooperating second passages, a removable locking pin extending through the cooperating passages of the mount to temporarily hold the skid mounted pressure washers in place.

2. A mobile system as defined by claim 1 and further comprising:

a holding tank provided in the lower level;

at least one intake pump upstream and in communication with the holding tank, the at least one intake pump provided in the upper level; and, a fluid intake collector external to the vehicle for collecting dispensed fluid upstream from and in communication with the at least one intake pump.

3. A mobile system as defined by claim 2 and further comprising at least one filter station located upstream from the holding tank and downstream from the fluid intake collector, the at least one filter station provided on the vehicle upper level.

4. A mobile system as defined by claim 3 wherein the at least one filter station comprises a plurality of filter elements arranged in series, a first filter element having a first aperture size, a plurality of second filter elements comprising a series of filters having steadily decreasing aperature sizes in a flow direction towards the holding tanks.

5. A mobile system as defined by claim 4 wherein at least one of the filter elements further comprises a settling tank for settling out solids, a float switch and pump provided with the settling tank for urging its contents toward the second filter station upon activation of the float switch pump.

6. A mobile system as defined by claim 4 and wherein the at least one filter station further comprises a cyclone separator arranged between the first filter element and at least one of the plurality of second filter elements, the cyclone separator operative to separate out solids.

7. A mobile system as defined by claim 2 and further comprising:

a pH modifying material supply in communication with the holding tank; and, a metering pump in communication with a hydrogen peroxide supply tank for supplying metered amounts of pH altering material for controlling the pH of liquid in the holding tank.

8. A mobile system as defined by claim 2 wherein the fluid intake collector is external to the vehicle and includes one or more of a boom collector that pools dispensed fluids for collection and a sump container adapted for placement into a sewer aperature whereby water flowing into the sewer aperature is collected in the sump and communicated to the intake pump.

9. A mobile system as defined by claim 2 and further comprising:

a conduit connecting the holding tank to the clean fluid supply for communicating fluid from the holding tank to the clean fluid supply;

a valve arranged in the conduit for selectively isolating the holding tank from the clean fluid supply;

a pump in communication with the conduit for urging fluid from the holding tank into the clean fluid supply; and, a controller connected to the pump and valve for operating the valve and pump.

10. A mobile system as defined by claim 1 wherein the vehicle interior defines an interior height, the lower vertical portion extending vertically for less than half the height and the upper vertical portion extending vertically for more than half the height, the lower and upper vertical portions collectively extending for the entire height.

11. A mobile system as defined by claim 9 wherein the vehicle interior defines an interior height, the lower vertical portion extending vertically for no more than 33% of the height.

12. A mobile system as defined by claim 1 wherein the vehicle interior defines a length and a width, both of the lower and upper vertical portions extending over the entire width, both of the lower and upper vertical portions each having a length that are coextensive with one another and that are less than the vehicle interior length wherein the lower and upper vertical portions do not extend into at least a portion of the vehicle interior that defines a full height interior portion.

13. A mobile system as defined by claim 12 wherein:

the full height portion is arranged toward a rear of the vehicle interior; and, wherein the vehicle further comprises a rear access door for accessing the full height portion.

14. A mobile system as defined by claim 2 wherein:

the vehicle is a trailer configured to be towed by a tractor vehicle, the vehicle defining a front end for connecting to the tractor vehicle;

the holding tank is arranged adjacent to the trailer front end and includes planar top, bottom and sidewalls that are coplanar and proximate to adjacent trailer walls, the holding tank made of a polymer material and spanning substantially all of the width of the trailer; and, the clean fluid supply tank is arranged behind the holding tank close to a lengthwise center of the vehicle and includes planar top, bottom and sidewalls that are coplanar with and proximate to trailer walls, the holding tank made of a polymer material.

15. A mobile system as defined by claim 1 and further comprising a clean fluid supply fill conduit that extends from the clean fluid supply through a vehicle wall to a fill port useful to introduce fluid from external to the vehicle into the clean fluid supply, a backflow preventer provided in the conduit to prevent backflow from the clean fluid supply, the backflow preventer including an air gap across which fluid drops by force of gravity towards the clean fluid supply.

16. A mobile system as defined by claim 1 wherein the at least one outflow pump comprises a plurality of pressure washers each of which includes a heater for heating the clean fluid, the pressure washers communicating with discharge ports arranged at the rear of the vehicle, and further comprising:

at least one ventilation panel in the vehicle to allow in-flow of air to the vehicle; and at least one exhaust discharge conduit for discharging exhaust from the vehicle interior.

17. A mobile system as defined by claim 1 wherein the at least one outflow pump comprises at least four pressure washers, each of which is mounted on a skid, the skid removably attached to the deck using a plurality of lugs having first passages, the lugs received in mounts on the deck that include receiving cavities with cooperating second passages, a locking pin extending through the cooperating passages to hold the skid mounted pressure washers in place.

18. A mobile system as defined by claim 2 and further comprising a plumbing manifold located in a cabinet that has doors accessible from the exterior of the vehicle, the plumbing manifold having a plurality of valves in communication with the at least one outflow pump and at least one intake pump.

19. A mobile system as defined by claim 1 and further comprising:

the vehicle comprising a trailer and having a height, defining a front end configured to be attached to a towing tractor and a distal rear end along a length of the trailer;

the lower level provided in the interior and having a height that is no more than about 33% of the interior height;

the upper level provided in the interior and separated from the underlying lower level by a deck, the upper and lower levels coextensive with one another, the upper and lower levels having a length that is less than the length of the trailer;

a full height portion of the interior arranged near the rear of the trailer behind the upper and lower levels along the length of the trailer;

the clean fluid supply tank located on the lower level arranged proximate to a center of the trailer along its length;

a plurality of pressure washers arranged on the upper level and in communication with the clean fluid supply tank, the pressure washers each including a heater, the pressure washers each mounted on a skid that is removably attached to the deck;

a plurality of discharge ports arranged at the rear of the vehicle, one each of the discharge ports communicating with one each of the pressure washers and configured to discharge cleaning fluid at the jobsite;

a holding tank located on the lower level arranged proximate to the front of the trailer in front of the clean fluid supply tank along the length of the trailer;

at least one intake pump located on the upper level for returning the dispensed cleaning fluid from the jobsite;

a plurality of filter elements arranged near the front of the interior on the upper level, the filter elements in communication with the intake pump and with the holding tank, and configured to clean the returned fluid, the plurality of filter elements including progressively decreasing aperature sizes in a flow direction toward the holding tank;

a pH modifying material supply in communication with the holding tank;

a metering pump in communication with the hydrogen peroxide supply tank for supplying metered amounts of pH altering material for controlling the pH of liquid in the holding tank; and, a full height potion of the interior defined proximate to the rear of the trailer and behind the upper and lower levels along the length of the trailer.

20. A mobile system as defined by claim 19 and further comprising:

a conduit connecting the clean fluid supply tank to the holding tank, a valve in the conduit wherein cleaned fluid held in the holding tank may be communicated to the clean fluid supply tank for reuse;

a plurality of storage tanks in the trailer full height portion;

a manifold located below a trailer bottom wall, the manifold containing plumbing controls and accessible from external of the trailer; and, at least one of a boom collector and a catch basin for deploying external to the trailer to collect dispensed fluid for return to the trailer and cleaning by the filter elements.

* * * * *